US012529227B2

(12) United States Patent
Michel

(10) Patent No.: US 12,529,227 B2
(45) Date of Patent: Jan. 20, 2026

(54) ALUMINIUM GUTTER SYSTEM

(71) Applicant: Clear Amber Group Ltd, Perth (GB)

(72) Inventor: Murray Michel, Perth (GB)

(73) Assignee: Clear Amber Group Ltd, Perth (GB)

( * ) Notice: Subject to any disclaimer, the term of this patent is extended or adjusted under 35 U.S.C. 154(b) by 225 days.

(21) Appl. No.: 18/338,558

(22) Filed: Jun. 21, 2023

(65) Prior Publication Data

US 2023/0417059 A1 Dec. 28, 2023

(30) Foreign Application Priority Data

Jun. 22, 2022 (GB) ..... 2209184
Sep. 21, 2022 (GB) ..... 2213785

(51) Int. Cl.
*E04D 13/072* (2006.01)
*E04D 13/068* (2006.01)

(52) U.S. Cl.
CPC ..... *E04D 13/0727* (2013.01); *E04D 13/068* (2013.01)

(58) Field of Classification Search
CPC . E04D 13/072; E04D 13/0727; E04D 13/068; E04D 13/0685

(Continued)

(56) References Cited

U.S. PATENT DOCUMENTS 4,195,452 A * 4/1980 Smith ..... E04D 13/0725 248/48.1
4,581,857 A * 4/1986 Harbom ..... E04D 13/0725 52/12

(Continued)

FOREIGN PATENT DOCUMENTS

CN 110453853 A 11/2019
DE 2346518 A1 * 4/1975

(Continued)

OTHER PUBLICATIONS

Combined Search and Examination Report for corresponding Application No. GB2209184.7, dated Dec. 21, 2022, 8 pages.

(Continued)

*Primary Examiner* — Christine T Cajilig
(74) *Attorney, Agent, or Firm* — Dority & Manning, P.A.

(57) ABSTRACT

A guttering kit or assembly comprising at least one gutter piece and at least one mounting bracket for mounting the gutter piece to a surface, wherein the gutter piece comprises an elongate drainage channel and one or more mounting parts, each of the one or more mounting parts comprising an extending part that extends from, and away from, an external side wall portion of the drainage channel at least to a pair of lock pieces that extend from, and away from, the extending piece and away from each other; and the mounting bracket comprises a mounting member for mounting to the surface, and a pair of opposing slots, each of the opposing slots being formed by a respective slot forming member, each slot forming member comprising a spacing portion that extends obliquely or perpendicularly away from the mounting member to an end portion that extends obliquely or perpendicularly from the spacing portion so as to form the slot between the end portion and the mounting member; and wherein respective slots of the pair of opposing slots of the mounting bracket accommodate or are configured to receive respective lock pieces of the pair of lock pieces to mount the gutter piece to the mounting bracket.

18 Claims, 19 Drawing Sheets

(58) Field of Classification Search
USPC ..... 52/11
See application file for complete search history.

(56) References Cited

U.S. PATENT DOCUMENTS

| | | | | | |
|---|---|---|---|---|---|
| 4,622,785 | A | * | 11/1986 | Miller | E04D 13/0725 248/48.2 |
| 5,038,528 | A | * | 8/1991 | Brant | E04D 13/068 248/48.1 |
| 6,092,339 | A | * | 7/2000 | Hall | E04D 13/0727 52/12 |
| 6,749,156 | B1 | * | 6/2004 | Buehlmeyer | E04D 13/0722 248/48.1 |

FOREIGN PATENT DOCUMENTS

| | | | | | |
|---|---|---|---|---|---|
| EP | 0481819 | A | | 4/1992 | |
| EP | 0511758 | A | | 11/1992 | |
| FR | 1302741 | A | * | 8/1962 | |
| GB | 2321481 | A | | 7/1998 | |
| GB | 2327955 | A | | 2/1999 | |
| GB | 2329401 | A | * | 3/1999 | E04D 13/0727 |
| GB | 2335673 | A | | 9/1999 | |
| GB | 2397830 | A | | 8/2004 | |
| GB | 2419613 | A | * | 5/2006 | E04D 13/064 |
| JP | H10140763 | A | | 5/1998 | |
| JP | H10183905 | A | | 7/1998 | |
| JP | 2005155250 | A | * | 6/2005 | |
| JP | 2007120036 | A | * | 5/2007 | |

OTHER PUBLICATIONS

Combined Search and Examination Report for corresponding Application No. GB2213785.5, dated Mar. 3, 2023, 6 pages.

* cited by examiner

ALUMINIUM GUTTER SYSTEM

FIELD

The present disclosure relates to a gutter system, and particularly but not exclusively to an aluminium gutter system.

BACKGROUND

Guttering is conventionally attached to a wall of a building adjacent a roof line in order to catch water running off the roof. The guttering is generally attached to the wall of the building by brackets. There is a need for guttering that is easier and/or more convenient to install.

SUMMARY

Various examples of the present disclosure are defined by the independent claims. Some preferred features are defined in the dependent claims.

According to a first example of the present disclosure is a gutter piece for a guttering system, the gutter piece comprising an elongate drainage channel and one or more mounting parts. The one or more mounting parts may each comprise an extending part that extends from and away from an external side wall portion of the drainage channel at least to a pair of lock pieces that extending from away from the extending piece and away from each other. The drainage channel may be a watertight drainage channel, e.g. for conveying water along the length of the gutter piece.

The extending part and the pair of lock pieces may form a substantially T-shaped cross section. The lock pieces of the pair of lock pieces may extend in opposite directions from each other. The lock pieces of the pair of lock pieces may be co-planar. The lock pieces of the pair of lock pieces may be configured to extend vertically in use. The pair of lock pieces may be spaced apart and/or away from the external side wall portion of the drainage channel by the extending part. The free or distal end of one or both of the lock pieces may be chamfered.

The extending part may extend from an intermediate part of the external side wall portion of the drainage channel that is away from a mouth of the drainage channel.

The drainage channel may have a substantially U-shaped profile. The drainage channel may be a closed channel open at the mouth thereof. The open mouth of the drainage channel may extend longitudinally along most or all of the length of the drainage channel. The mouth of the drainage channel may be defined by longitudinally extending terminal edges of the side wall portions of the drainage channel. The gutter piece may be configured so that the mouth of the drainage channel faces upwards in use, i.e. when the gutter piece is mounted to a vertical wall. The drainage channel may comprise a pair of side wall portions that each extend from the mouth of the channel in a cross sectional profile of the drainage channel to a joining portion that joins the two side wall portions of the drainage channel. At least an interior surface of the drainage channel may continuously curve over most or all of the cross section of the drainage channel, e.g. through one of the side wall portions, the joining portion and the other of the side wall portions. The cross sectional profile of the drainage channel may be a lateral cross sectional profile that extends in a plane perpendicularly to the longitudinal direction of the drainage channel, which may be in a vertical plane in use.

The one or more mounting parts may be configured to engage a mounting bracket in order to support the gutter piece in use, e.g. on a wall of a building.

At least part of an edge of the drainage channel that partly defines the mouth of the drainage channel, e.g. of one of the side wall sections of the drainage channel, may define a recess. The recess may be defined in an edge of the drainage channel that is closest to the mounting bracket in use. The recess may be formed by the edge of the side wall of the gutter channel extending around and back towards an interior of the drainage channel so as to define the recess. The recess may be a slot that may extend longitudinally along some, most or all of the length of the mouth of the gutter channel. The recess may be configured to receive an edge of a connector. A terminal end of the edge of the drainage channel that defines the recess may be chamfered or radiused.

Another edge of the drainage channel, which may be an edge of the drainage channel opposite the edge of the sidewall portion of the drainage channel that defines the recess, may define an outwardly protruding portion, which may extend longitudinally along some, most or all of the length of the other edge of the drainage channel. The other edge of the drainage channel may comprise a thickened bead portion, which may extend longitudinally along some, most or all of the length of the other edge of the drainage channel. The outwardly protruding portion may be comprised in the thickened bead. The thickened bead may form an edge of the other side wall portion of the drainage channel having a thicker cross section (e.g. the lateral cross section) than most or all of the rest of the drainage channel.

An inner portion of the other edge of the drainage channel, e.g. of the thickened bead, may comprise a catch, which may extend out from an inner side of the other side wall portion of the drainage channel and may also extend downwardly towards the interior of the drainage channel. The catch may be configured to resiliently receive and releasably lock a corresponding catch member of a connector for connecting two gutter pieces. The catch may be configured to resiliently receive and releasably lock a corresponding catch member of a connector when the connector is in a position abutting the interior of the drainage channel of the gutter piece.

The other edge of the drainage channel may comprise a fixing or connecting structure. The fixing or connecting structure may be configured for fixing the connector to the drainage channel. The fixing or connecting structure may be configured to receive and/or fix to a fixing provided in or through part of the connector. The fixing or connecting structure may comprise a recess for receiving the fixing therein, wherein the recess is optionally threaded to allow screw engagement by the fixing. The fixing or connecting structure may be provided in the outwardly protruding portion. The fixing or connecting structure may be provided adjacent and/or proximate the thickened bead portion. The fixing or connecting structure may be provided between the thickened bead portion and the interior of the drainage channel. An opening of the recess may be provided in a flat surface of the other edge of the drainage channel, which may be configured to engage and/or abut a corresponding outer flat section of the connector.

The gutter piece may be formed from aluminium.

According to a second example of the present disclosure is a mounting bracket for mounting a gutter piece, e.g. to a surface such as a wall or other vertical surface, the mounting bracket comprising a mounting member. The mounting member may be a surface engaging member configured to engage the surface in use. The mounting member may be or comprise a substantially planar or sheet like member. The mounting bracket may comprise a pair of opposing slots, each of the opposing slots being formed by a respective slot forming member that may comprise a spacing portion that extends obliquely or perpendicularly away from the mounting member to an end portion that extends obliquely or perpendicularly from the spacing portion so as to form the slot between the end portion and the mounting member. The end portion of the slot forming member may extend generally in parallel with the mounting member. The end portions of the respective slot forming member may extend from their respective spacing portions towards each other.

One of the slot forming members and associated slot may be an upper slot forming member and upper slot, and the other of the slot forming members and associated slot may be a lower slot forming member and lower slot. The upper slot forming member and upper slot may be configured to be higher than or above, e.g. directly vertically above, the lower slot forming member and lower slot in use, e.g. when the mounting bracket is mounted to the surface, such as a vertical surface or wall.

One of the slots, e.g. the lower slot, may be a shallower and/or thinner slot than the other of the slots, e.g. the upper slot. The other of the slots, e.g. the upper slot, may be deeper and/or wider than the one of the slots, e.g. the lower slot. By deeper, it may mean that the end portion of the slot forming member extends further away from the respective spacing portion so as to form a deeper slot. By wider, it may mean that the spacing portion is longer so that the end portion of the slot forming member is spaced further away from the mounting member so as to form a wider slot. The end portion of one of the slot forming members, e.g. the upper slot forming member, may comprise a fixing hole for receiving a fixing such as a bolt or screw therethrough.

The mounting member may be configured to mount to the surface, and may comprise at least one fixing arrangement for fixing the mounting member to the surface. The fixing arrangements of the at least one fixing arrangements may comprise a screw hole. One of more of the fixing arrangements, which may be hidden fixing arrangements, may be provided between the respective slot forming members. The hidden fixing arrangements may be hidden behind the gutter piece in use when the gutter piece is mounted in the opposing slots. One or more of the fixing arrangements may be provided on the mounting member out with the pair of slot forming members, e.g. above or below the pair of slot forming members, in use.

The pair of slots may be configured to receive respective lock pieces of the pair of lock pieces of the gutter piece of the first example therein, e.g. in order to mount the gutter piece to the mounting bracket. The pair of slots may be configured to receive respective lock pieces of the pair of lock pieces of the gutter piece in a "rock and lock" arrangement.

In the "rock and lock" arrangement, in order to mount the gutter piece to the mounting bracket, one of the lock pieces may be angled obliquely and inserted into one of the slots (e.g. the wider and/or deeper slot such as the upper slot) and may be rotated towards vertical until the other lock piece is aligned with the other slot (e.g. the shallower and/or thinner slot such as the lower slot). The mounting part may then be moved so that the other lock piece is inserted into the other slot (e.g. the lower slot), such that at least part of each lock piece is inserted into a respective slot. Thereafter, the fixing such as a screw or bolt may be inserted into the fixing hole in the end portion of one of the slot forming members, e.g. the upper slot forming member, in order to lock the mounting part of the gutter piece in place.

In the "rock and lock" arrangement, in order to remove the gutter piece from the mounting bracket, the mounting process may be performed in reverse. The fixing may be removed from the fixing portion in the end portion of the one of the slot forming members, e.g. the upper slot forming member. The mounting part may then be moved so that the other lock piece is removed from the other slot (e.g. the lower slot). The mounting part may be rotated away from the vertical so that the other lock piece is rotated away from the mounting bracket. The one of the lock pieces may be removed from the one of the slots (e.g. the wider and/or deeper slot such as the upper slot).

The mounting bracket may be formed from aluminium.

According to a third example of the present disclosure is a connector for connecting two gutter pieces, such as two gutter pieces of the first example. The connector may be an elongate connector. The connector may have a length that is shorter than the gutter pieces, e.g. less than 20%, preferably less than 10% of the length of the gutter pieces. The connector may have a substantially U-shaped cross sectional profile. The connector may define a fluid channel, which may run along the length of the connector. The connector may have a shape complementary to that of the gutter pieces, e.g. to the inside of the drainage channels of the gutter pieces. The connector may be configured to fit to the inside of the drainage channels of the gutter pieces. The fluid channel defined by the connector may be an open fluid channel, open at a mouth thereof. The fluid channel may be a water tight fluid channel and may be configured to convey fluid therealong. The open mouth of the fluid channel may face upwardly in use. The open mouth of the fluid channel may be provided between opposing edges of a wall of the connector that defines the fluid channel.

One edge of the wall of the connector may comprise a chamfered edge, which may slope downwardly from an exterior of the wall of the connector towards an interior. The chamfered edge may be an edge of the wall of the connector closest to the mounting bracket in use. The chamfered edge may be configured to be received within the recess defined in the edge of the drainage channel.

The other edge of the wall of the connector may comprise an outer flat section. The outer flat section may be provided at a distal end part of the edge of the wall of the connector. The outer flat section may be angled or perpendicular to a section of the wall of the connector adjacent to it, e.g. via a discontinuity in the curvature of the wall of the connector. The flat section may be arranged to be horizontal in use. The flat section may be arranged to extend outwardly from an outer side of the wall of the connector, e.g. away from the chamfered edge.

The connector may comprise a fixing or connecting arrangement, which may be or comprise a screwhole or guide for a fixing such as a screw or bolt or the like. The fixing or connecting arrangement may be configured to allow the connector to be connected to at least one or each of the at least two gutter pieces. The fixing or connecting arrangement may be configured to permit or guide the fixing therethrough so as to engage and fix to the at least one or each of the at least two gutter pieces. The fixing or connecting arrangement may be provided at, in or through the other edge of the wall of the connector, e.g. at, in or through the distal end part of the edge of the wall of the connector. The fixing or connecting arrangement may be provided at, in or through the outer flat section. The fixing or connecting arrangement may be configured to align with, e.g. to overlap in a plan view, the fixing or connecting structure of at least one or two of the gutter pieces, at least when the connector is in it's "in use" position with respect to the one or two gutter pieces in which it connects the gutter pieces. The fixing or connecting arrangement may be configured or configurable so that the fixing can engage and/or pass through or into both the fixing or connecting arrangement of the connector and the fixing or connecting structure of at least one or two of the gutter pieces, e.g. when the connector is located in it's "in use" position with respect to the one or two gutter pieces in which it connects the gutter pieces.

The connector may comprise a catch member. The catch member may extend outwardly from an outer surface of the wall of the connector, e.g. of a side wall part of the wall of the connector. The catch member may be provided away from the edges of the connector. The catch member may be provided proximate or on the same side of the connector as the flat section. The catch member may be provided on a different side of the connector to the chamfered edge. The catch member may be configured to resiliently and releasably lock the catch of at least one or both of the gutter pieces. The catch member on the connector and the catch on the gutter piece or pieces may form cam surfaces so they cam over each other as they are being engaged together. The catch member on the connector and the catch on the gutter piece or pieces may be inverted with respect to each other. The above arrangements may help keep the keeps the walls of the gutter pieces separated from the connector on the final approach prior to the engagement of the catches. This may help to leave any sealant between the connector and gutter piece or pieces intact and not smudged during the final engagement of the connector with the gutter pieces.

A spacer member may be provided on the outer surface of the side wall section of the wall of the connector, e.g. on a side of the connector that is opposite to the side on which the chamfered edge is provided. The spacer member may be provided proximate one or both of the flat section and/or the catch member of the connector. The spacer member may be provided between the flat section and the catch member of the connector. The spacer member may be provided between the catch member and the edge or other edge of the connector. The spacer member may be configured to extend outwardly and proud of an outer surface of the side wall section of the wall of the connector. In this way, the spacer member may create a gap between the outer surface of the side wall section of the connector and the inner surface of the drainage channel(s) of the gutter pieces in use. This may make it easier to insert a prying tool, such as a screwdriver into the gap to release the catch member from the catch and thereby the connector from the gutter piece or pieces.

The connector may be insertable into parts of the drainage channel of the respective gutter pieces to connect the gutter pieces. Sealant may be applied to ends of the inner surface of the drainage channels of the gutter pieces to be joined by the connector.

The connector may be lowered into at least the end parts of the drainage channels of both gutter pieces to be connected. One edge of the connector, e.g. the chamfered edge, may be inserted into the recess may be defined in an edge of the drainage channel of at least one or each of the gutter pieces to be connected, e.g. by rotating the connector. The connector may be rotated until at least one or each of: the catch member of the connector engages and locks with the catch of at least one or both gutter pieces, the spacer member of the connector abuts an interior surface of the drainage channel, e.g. of the thickened bead portion, of at least one or both of the gutter pieces to be connected, and/or the outer flat section of the connector abuts against at least one of: the thickened bead, the other edge of the drainage channel and/or the outwardly protruding portion of at least one or both of the gutter pieces to be connected.

The connector may be slidable into parts of the drainage channel of the respective gutter pieces to connect or join the gutter pieces. The connector may be slidable into one end of each of the gutter pieces in order to connect or join the gutter pieces. The connector may be slidable into one end of at least one or each of the gutter pieces until the fixing or connecting arrangement of the connector is aligned or in register with the respective fixing or connecting structure of the at least one or each of the gutter pieces.

The connector may be formed from aluminium.

According to a fourth example of the present disclosure is a kit or assembly comprising one or more or each of: one, two or more gutter pieces according to the first example, at least one mounting bracket according to the second example and/or at least one connector according to the third example.

According to a fifth example is a gutter system comprising two or more gutter pieces according to the first example, a plurality of mounting brackets according to the second example and at least one connector according to the third example. Each of the at least one mounting brackets may be mounted to a surface, such as a wall or other vertical surface, and connected to one or both of the gutter pieces so as to mount the gutter pieces to the surface. The mounting part of the gutter piece may be mounted to a corresponding mounting bracket by at least part of the lock pieces of the pair of lock pieces of the gutter piece being received in respective slots of the pair of slots of at least one of the mounting brackets.

Two of the two or more gutter pieces may be connected together by the connector. The one edge of the wall of the connector may comprise the chamfered edge, may be received within the recess defined in the edge of the drainage channel of both of the connected gutter pieces. The catch member of the connector may engage and locks with the catch of at least one or both gutter pieces. The spacer member of the connector may abut an interior surface of the drainage channel, e.g. of the thickened bead portion, of at least one or both of the gutter pieces. The outer flat section of the connector may abut against at least one of: the thickened bead, the other edge of the drainage channel and/or the outwardly protruding portion of at least one or both of the gutter pieces.

According to a sixth example of the present disclosure is a method of mounting and/or demounting a gutter piece of the first example to a mounting bracket of the second example.

The method may comprise inserting respective lock pieces of the pair of lock pieces of the gutter piece into respective slots of the pair of slots of the mounting bracket, e.g. in a "rock and lock" arrangement.

The method may comprise, in order to mount the gutter piece to the mounting bracket, angling one of the lock pieces obliquely and may further comprise inserting the one of the lock pieces into one of the slots (e.g. the wider and/or deeper slot such as the upper slot). The method may comprise then rotating the gutter piece so that the one of the lock pieces rotates towards vertical until the other lock piece is aligned with the other slot (e.g. the shallower and/or thinner slot such as the lower slot). The method may comprise then moving the mounting part so that the other lock piece is inserted into the other slot (e.g. the lower slot), such that at least part of each lock piece is inserted into a respective slot. The method may comprise inserting the fixing such as a screw or bolt into the fixing hole in the end portion of one of the slot forming members, e.g. the upper slot forming member, in order to lock the mounting part of the gutter piece in place.

The method may comprise, in order to remove the gutter piece from the mounting bracket performing the mounting process in reverse. The method may comprise removing the fixing from the fixing portion in the end portion of the one of the slot forming members, e.g. the upper slot forming member. The method may comprise moving the mounting part so that the other lock piece is removed from the other slot (e.g. the lower slot). The method may comprise rotating the mounting part away from the vertical so that the other lock piece is rotated away from the mounting bracket. The method may comprise removing one of the lock pieces from the one of the slots (e.g. the wider and/or deeper slot such as the upper slot) to thereby release the gutter piece from the mounting bracket.

According to a seventh example of the present disclosure is a method of connecting and/or deconnecting two gutter pieces of the first example using the connector of the third example.

The method may comprise, in order to connect the two gutter pieces, applying sealant to ends of the inner surface of the drainage channels of the gutter pieces to be joined by the connector. The method may comprise lowering, sliding or inserting the connector into at least the end parts of the drainage channels of both gutter pieces to be connected. The method may comprise inserting one edge of the connector, e.g. the chamfered edge, into the recess that may be defined in an edge of the drainage channel of at least one or each of the gutter pieces to be connected, e.g. by rotating the connector or by sliding the connector. The method may comprise rotating the connector until at least one or each of: the catch member of the connector engages and locks with the catch of at least one or both gutter pieces, the spacer member of the connector abuts an interior surface of the drainage channel, e.g. of the thickened bead portion, of at least one or both of the gutter pieces to be connected, and/or the outer flat section of the connector abuts against at least one of: the thickened bead, the other edge of the drainage channel and/or the outwardly protruding portion of at least one or both of the gutter pieces to be connected.

The method may comprise, in order to disconnect the two gutter pieces, inserting a prying tool, such as a screwdriver, into the gap formed by the spacer member of the connector between the outer surface of the side wall section of the connector and the inner surface of the drainage channel(s) of the gutter pieces to release the catch member from the catch and thereby the connector from the gutter piece or pieces. The method may comprise removing one edge of the connector, e.g. the chamfered edge, from the recess defined in an edge of the drainage channel of at least one or each of the gutter pieces, e.g. by rotating the connector.

According to an eighth example of the present disclosure is a method of producing any of: the gutter piece according to the first example, the mounting bracket according to the second example, or the connector according to the third example by additive manufacturing, extruding or moulding the gutter, the mounting bracket, or the connector.

According to a ninth example of the present disclosure is computer readable instructions configured to be read by a computer controlled additive manufacturing, milling or extrusion machine so as to configure the computer controlled additive manufacturing, milling or extrusion machine to produce any of: the gutter piece according to the first example, the mounting bracket according to the second example, or the connector according to the third example.

The individual features and/or combinations of features defined above in accordance with any aspect of the present disclosure or below in relation to any specific embodiment of the disclosure may be utilised, either separately and individually, alone or in combination with any other defined feature, in any other aspect or embodiment of the disclosure.

Furthermore, the present disclosure is intended to cover apparatus configured to perform any feature described herein in relation to a method and/or a method of using or producing, using or manufacturing any apparatus feature described herein.

BRIEF DESCRIPTION OF THE DRAWINGS

For a better understanding of the present disclosure and to show how embodiments may be put into effect, reference is made to the accompanying drawings in which.

DETAILED DESCRIPTION

Figure 1:
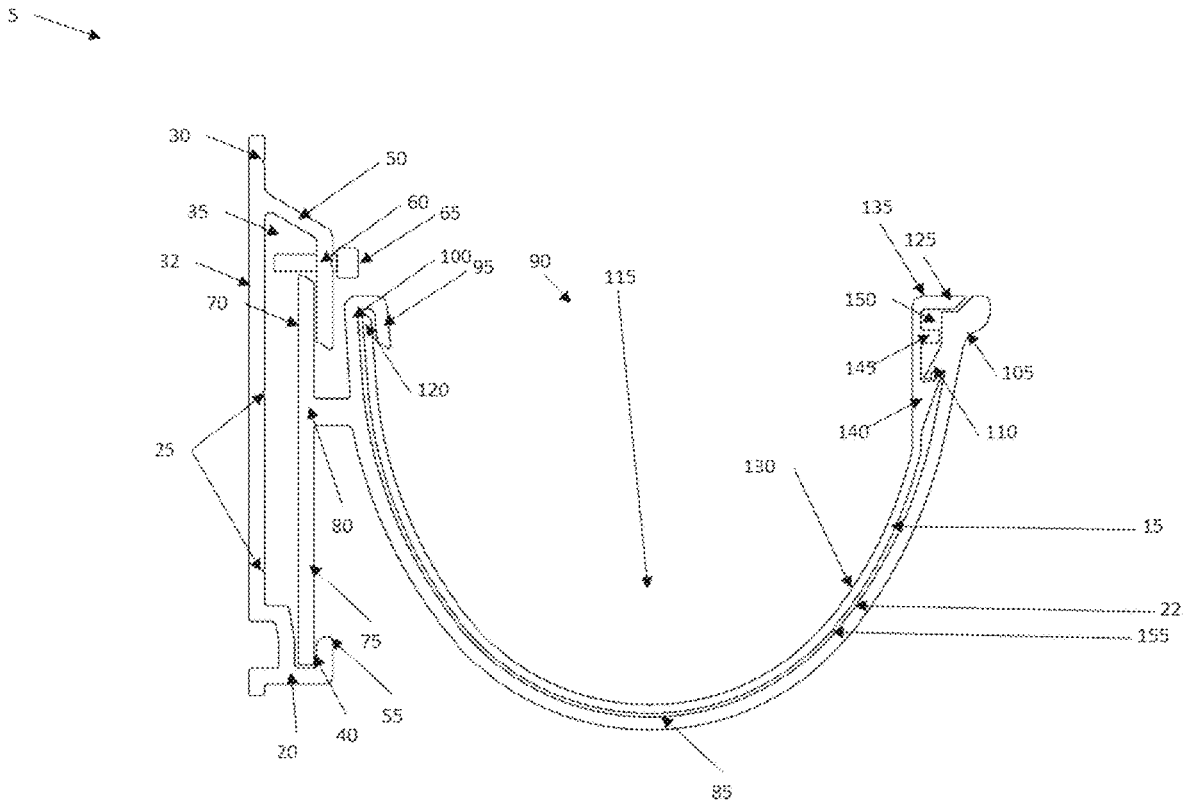
FIG. 1 is a cross section of a gutter system.
Figure 2:
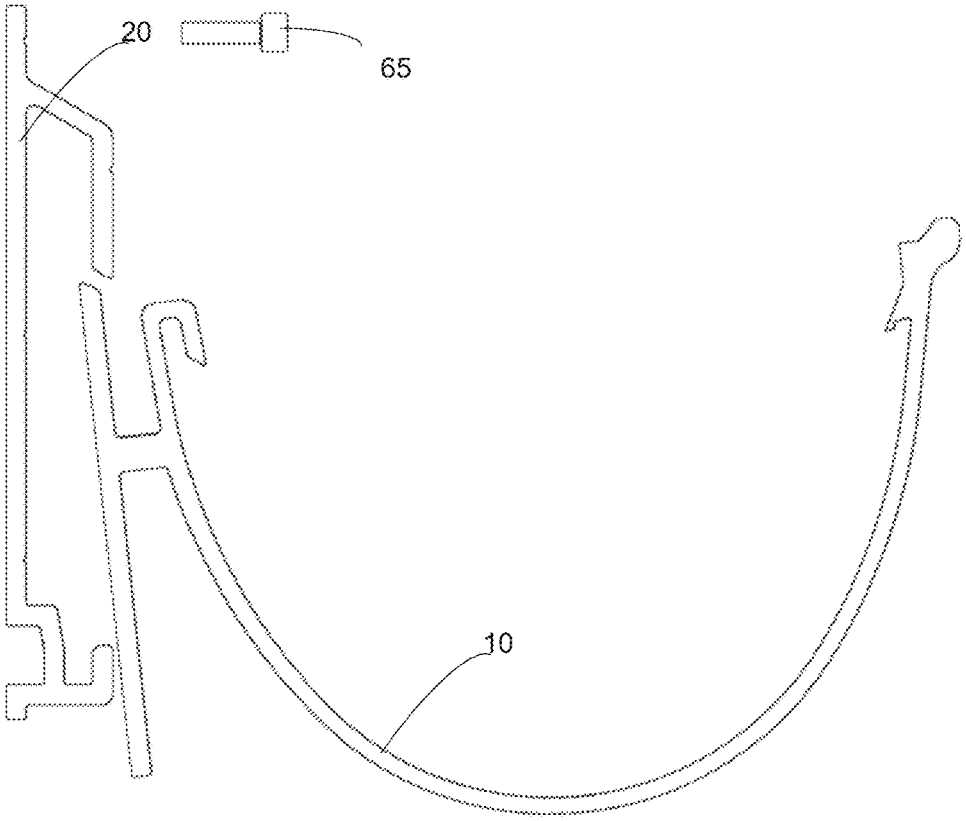
FIGS. 2 to 11 show the mounting of a gutter piece of the gutter system of FIG. 1 to a mounting bracket of the gutter system of FIG. 1.
Figure 3:
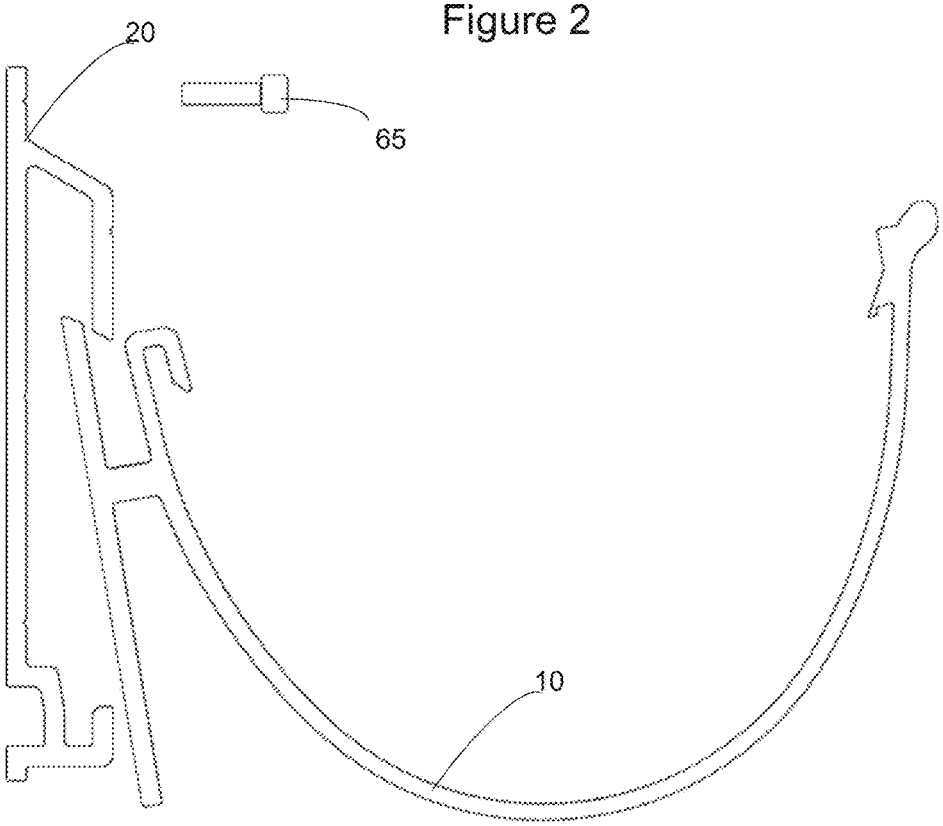
Figure 4:
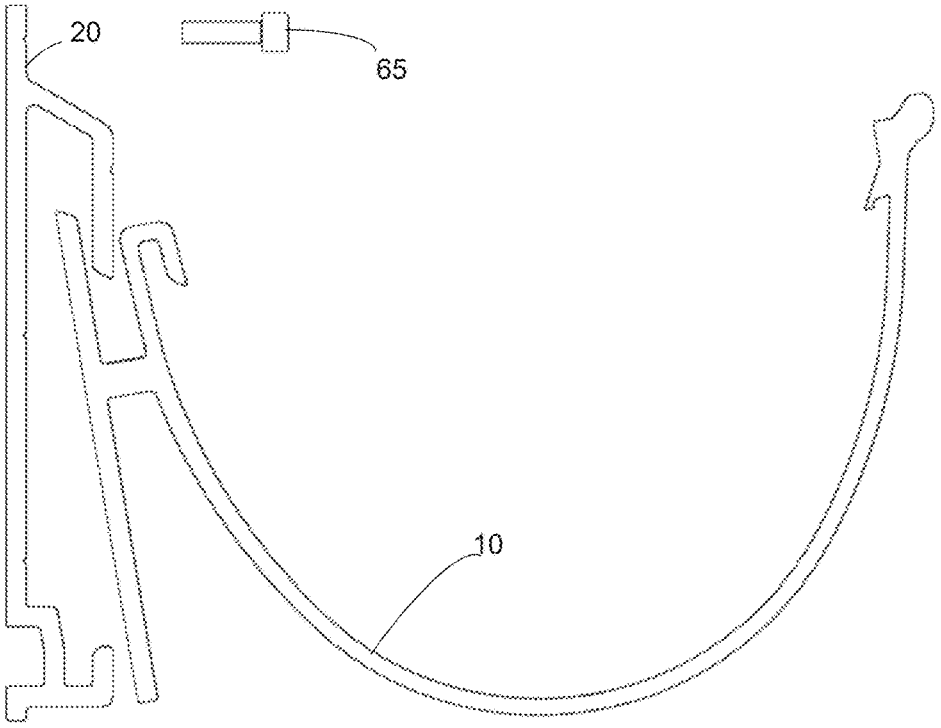
Figure 5:
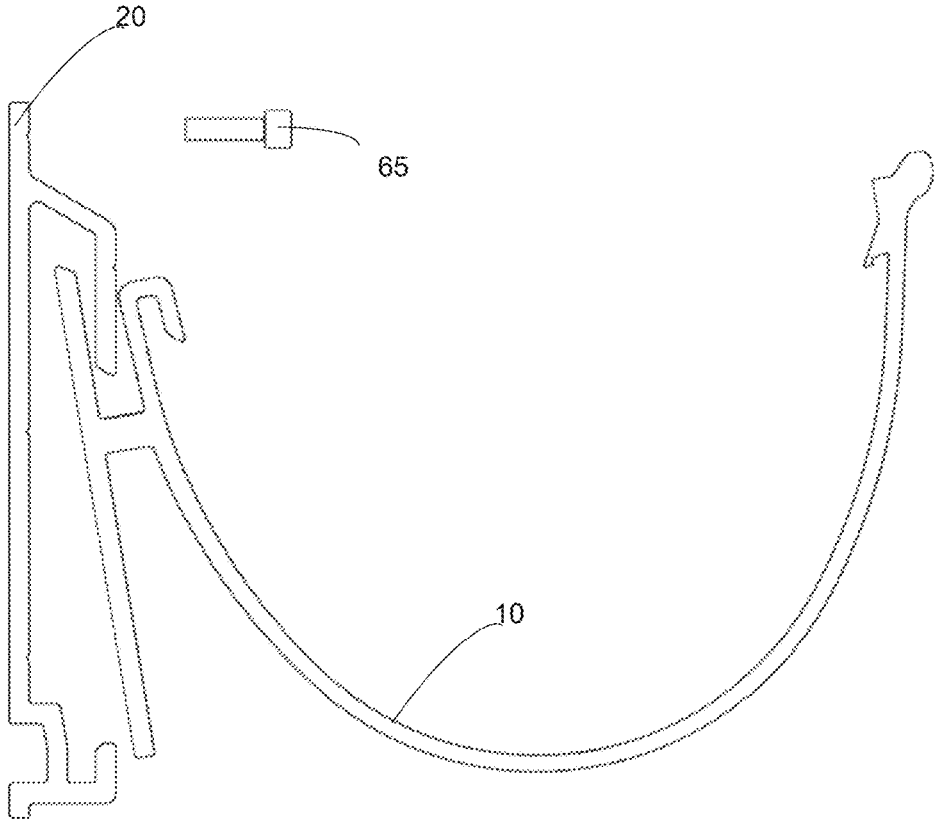
Figure 6:
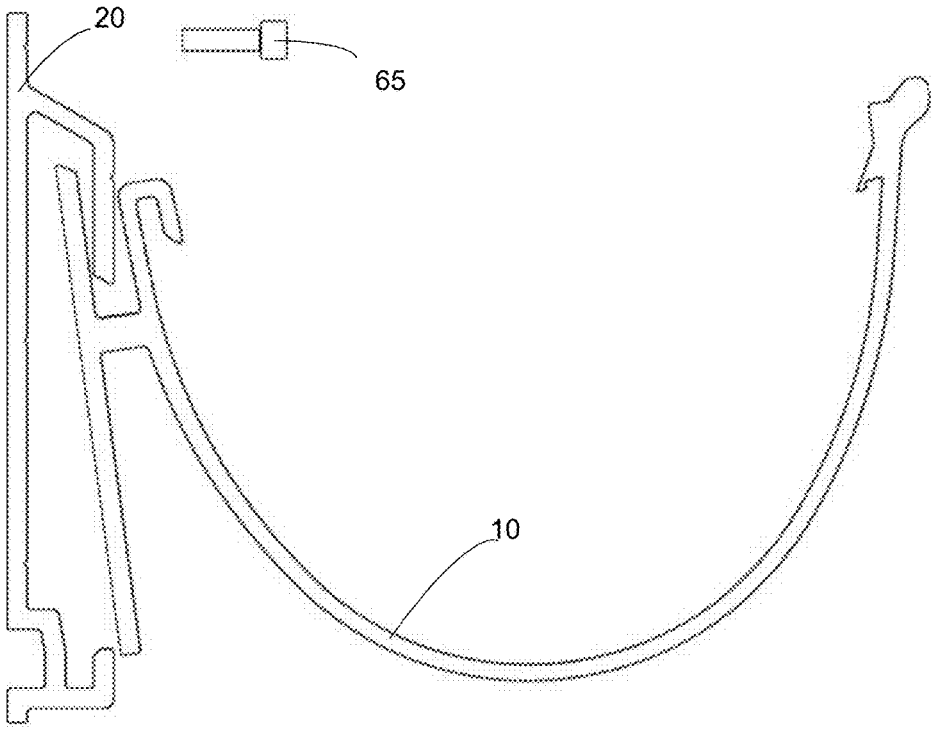
Figure 7:
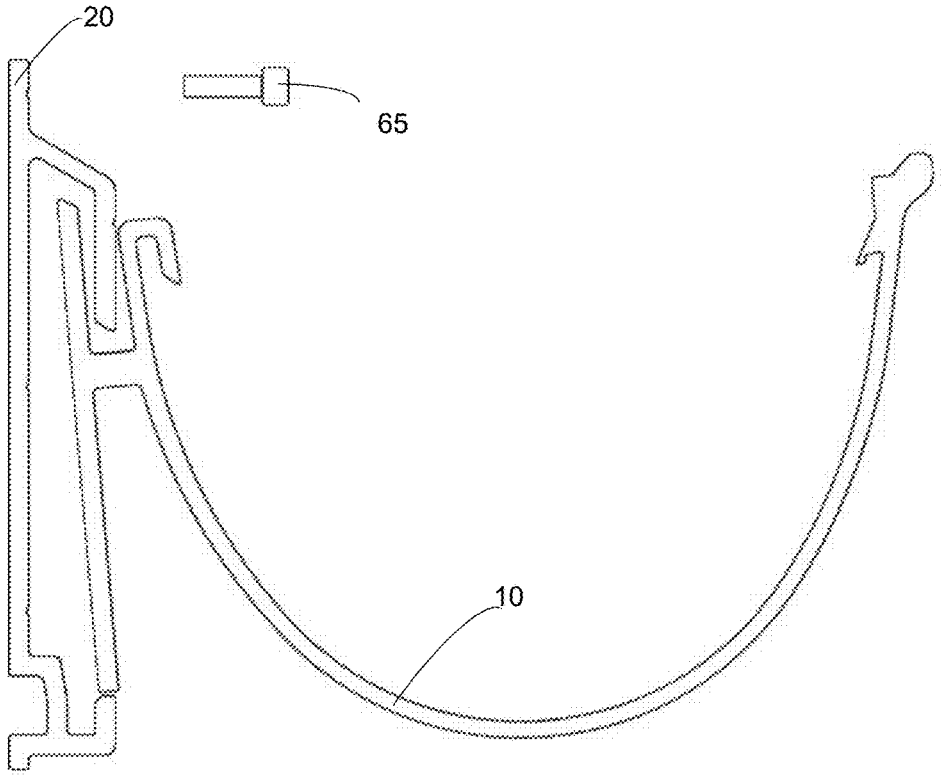
Figure 8:
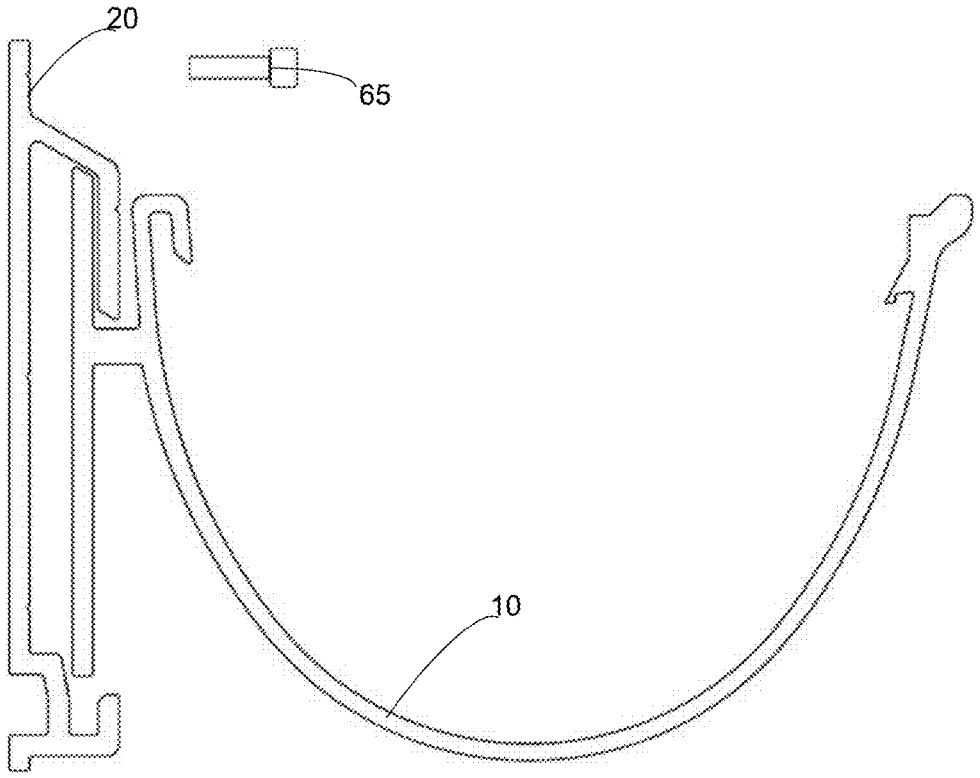
Figure 9:
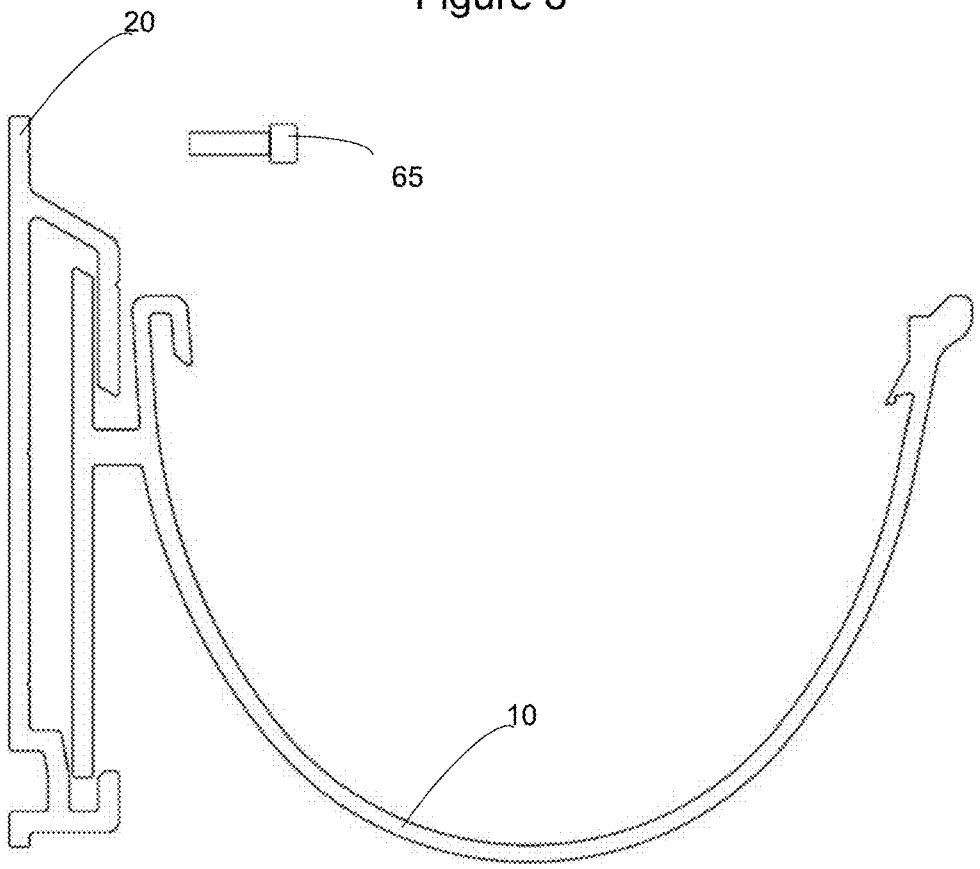
Figure 10:
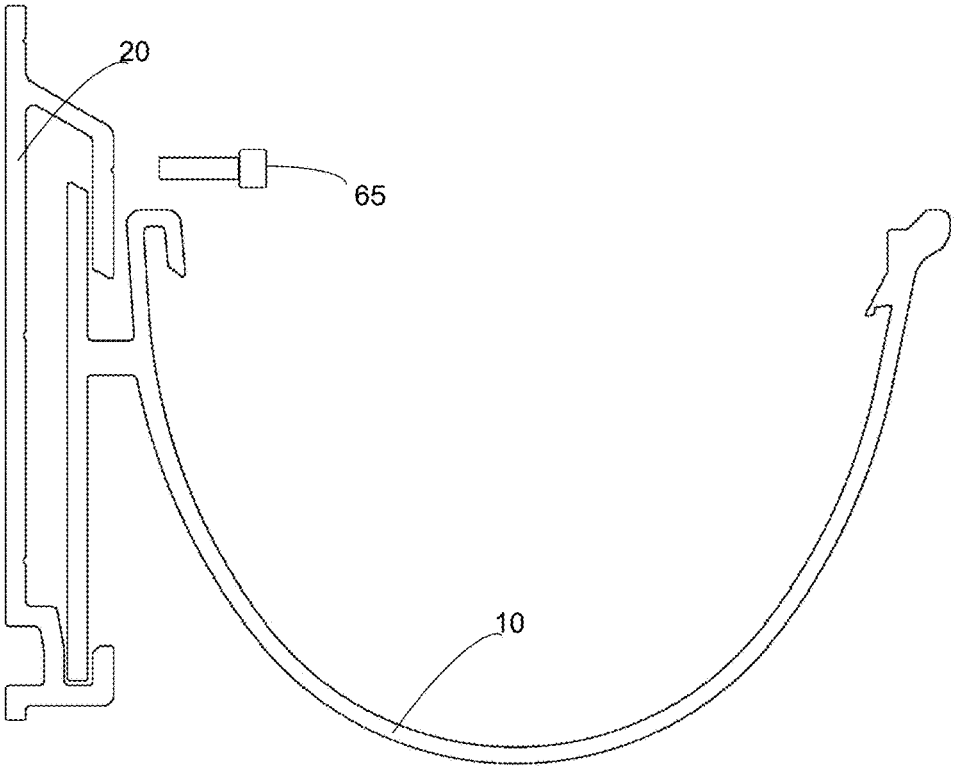
Figure 11:
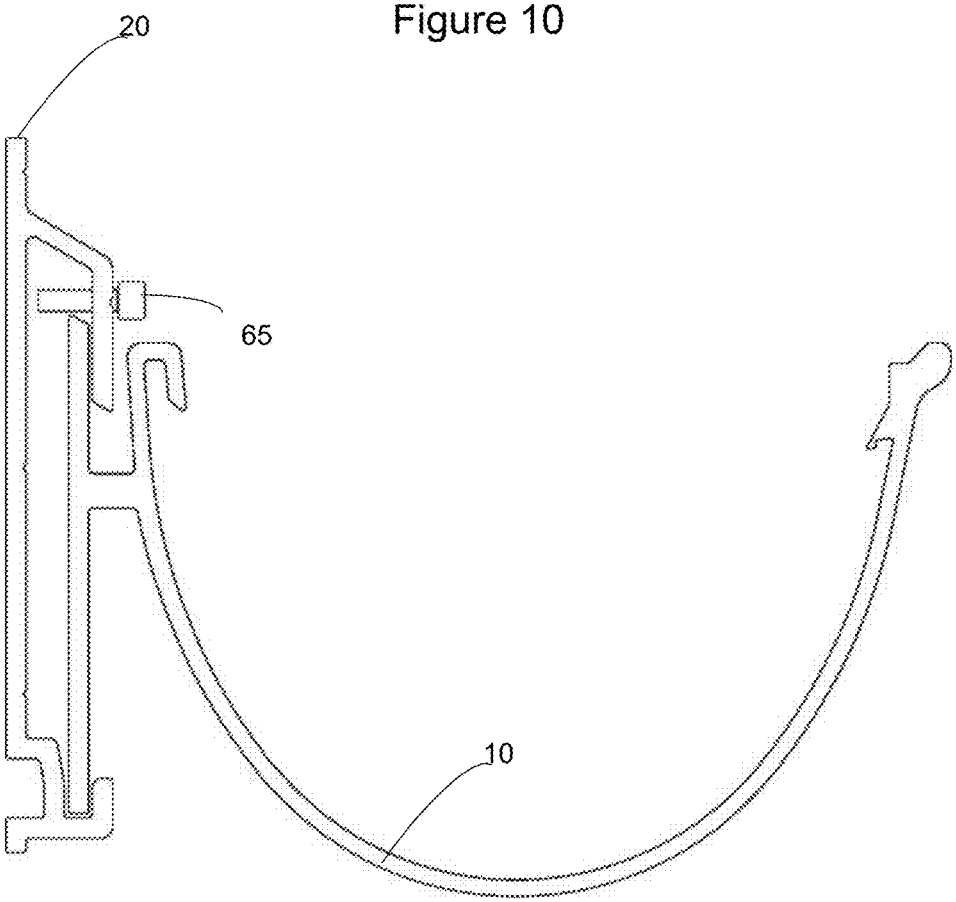
Figure 12:
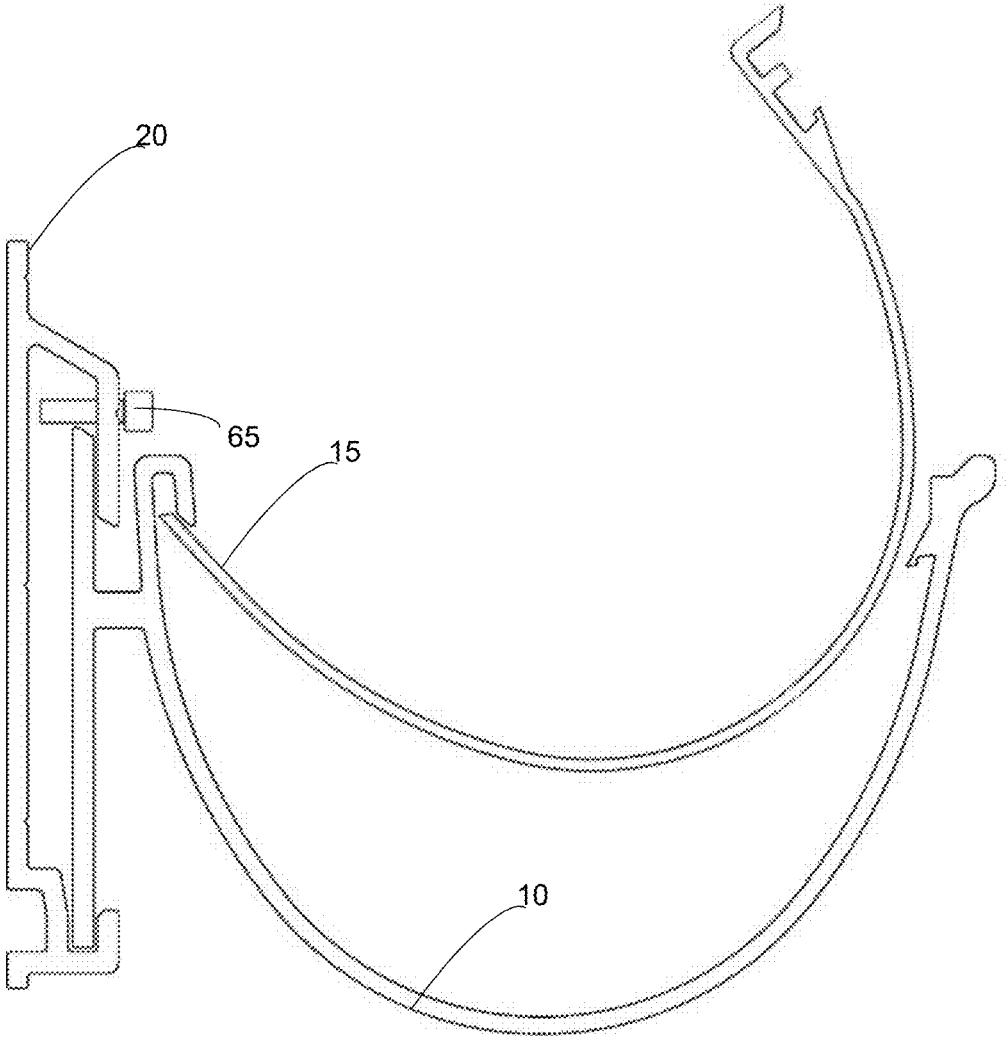
FIGS. 12 to 17 show the connecting of two gutter pieces of the gutter system of FIG. 1 using a connector of the gutter system of FIG. 1.
Figure 13:
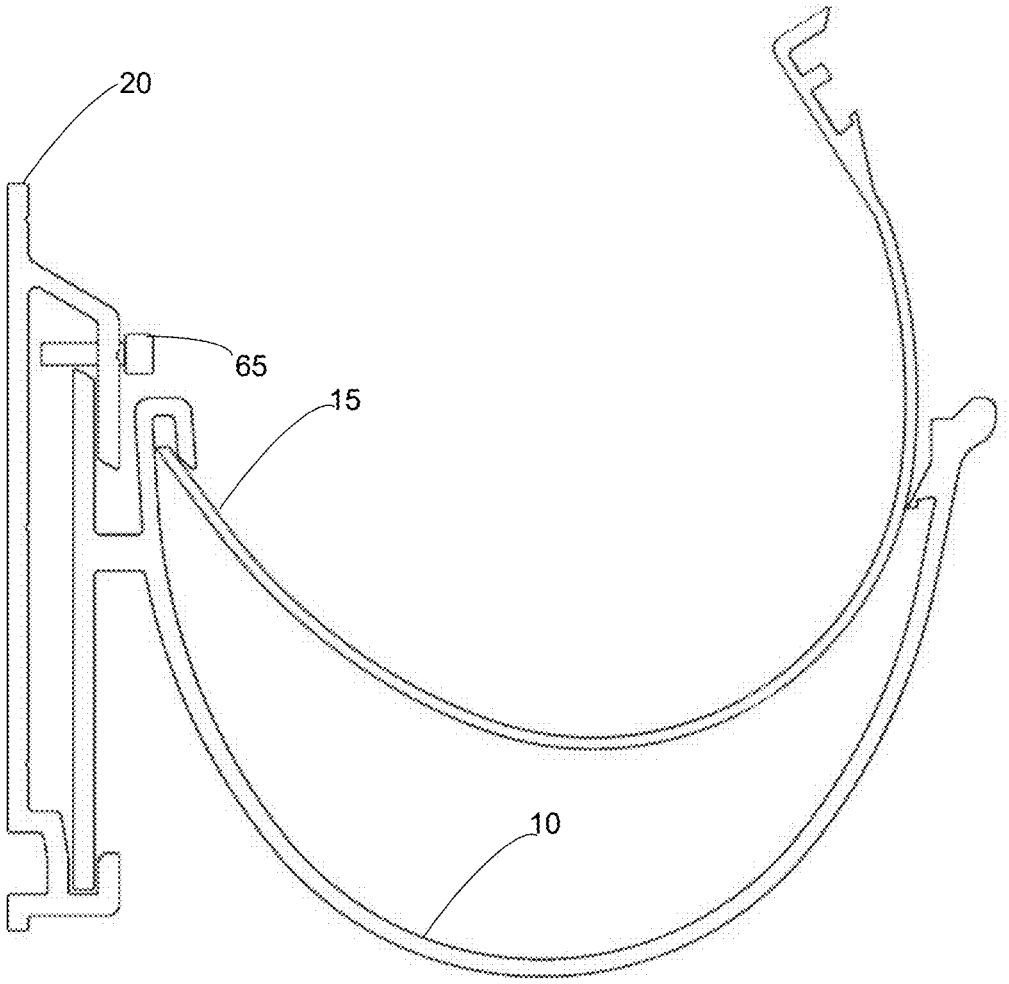
Figure 14:
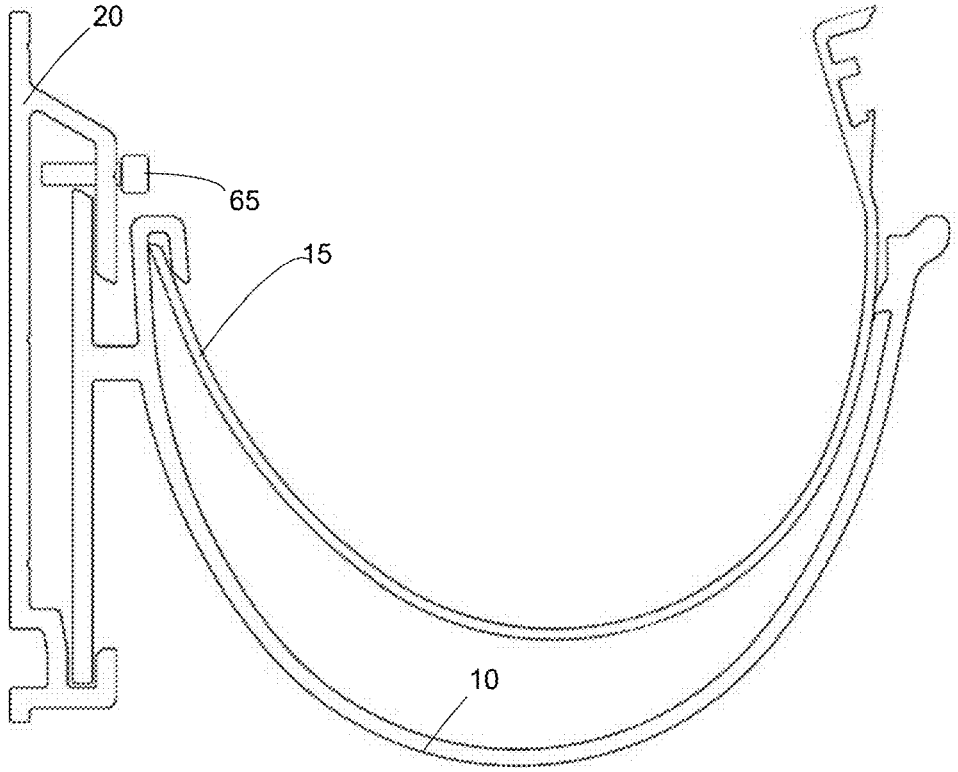
Figure 15:
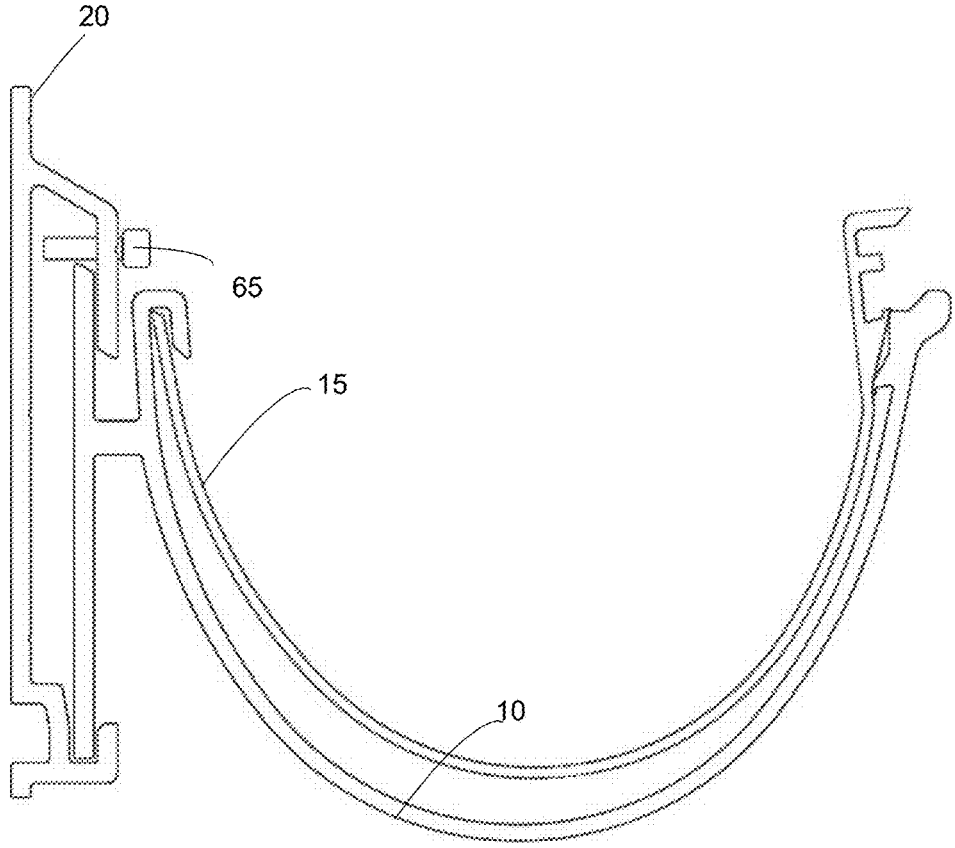
Figure 16:
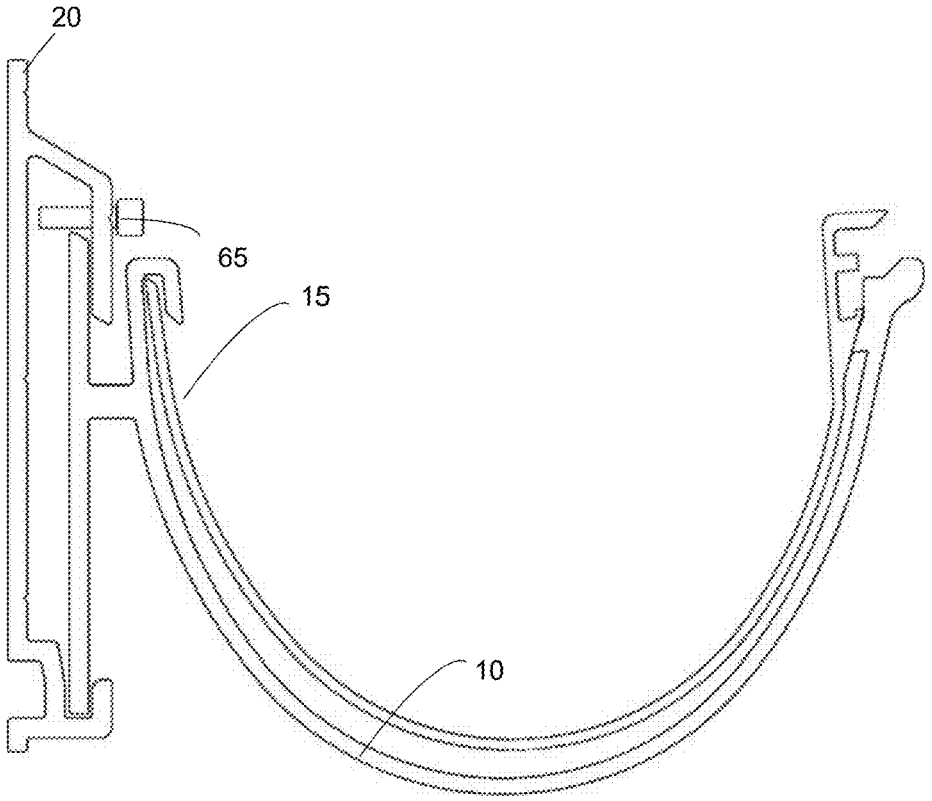
Figure 17:
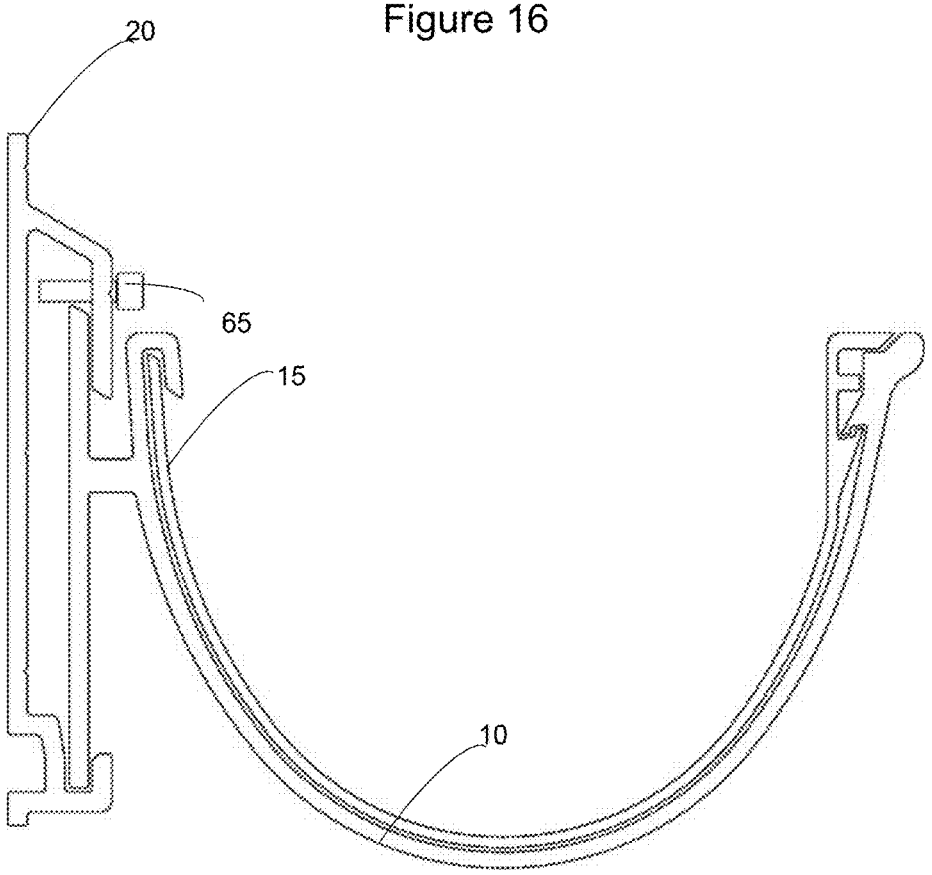

In the following detailed description, reference is made to the accompanying drawings that form a part hereof, and in which is shown by way of illustration specific embodiments in which the inventive subject matter may be practiced. These embodiments are described in sufficient detail to enable those skilled in the art to practice them, and it is to be understood that other embodiments may be utilized, and that structural, logical, and electrical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims and their equivalents.

In the following embodiments, like components are labelled with like reference numerals.

As used herein, except wherein the context requires otherwise, the terms "comprises", "includes", "has" and grammatical variants of these terms, are not intended to be exhaustive. They are intended to allow for the possibility of further additives, components, integers or steps.

Specific embodiments will now be described with reference to the drawings.

FIG. 1 illustrates a gutter system 5 shown in a lateral cross section. The gutter system 5 comprises at least two gutter pieces 10 (only one shown as the other gutter piece 10 is behind the shown gutter piece 10, into the page) connected by a connector The gutter system 5 also comprises a plurality of mounting brackets 20 (although again only one is shown as the other mounting brackets are hidden behind the shown mounting bracket 20) for mounting the gutter pieces 10 to a vertical surface in the form of a wall (see FIG. 18) in this example but could be e.g. a fascia or eaves of a building. The gutter pieces 10 are elongate, extending into the page. The connector 15 is also elongate and extends into the page but is considerably shorter than the gutter pieces 10. The brackets 20 may be of any width, e.g. long or short.

In use the brackets 20 are screwed into the wall (FIG. 18) using fixings such as screws (FIG. 18) 25 that are received through fixing points 25, 30 in the form of screw holes. The fixing points include at least one (e.g. two) concealed fixing points that are hidden behind the gutter pieces 10 in use and at least one unconcealed fixing point 30, in this case an upper fixing point above the gutter pieces 10 in use.

The mounting bracket 20 comprises a mounting member 32 that comprises the fixing points 25, 30. The mounting bracket 20 comprises a pair of opposing slots 35, 40, each of the opposing slots 35, 40 being formed by a respective slot forming flange 50, that extends obliquely or perpendicularly away from the mounting member and round so as to form the slot 35, 40 between the respective slot forming flange 50, 55 and the mounting member 32.

One of the slot forming flanges 50 is an upper flange and the associated slot 35 is an upper slot. The other of the slot forming flange 55 is a lower flange and the associated slot 40 is a lower slot. The upper slot forming flange 50 and upper slot 35 are located directly vertically above or at least higher than the lower slot forming flange and lower slot 40 in use, e.g. when the mounting bracket 20 is mounted to the wall.

Beneficially the upper slot forming flange 50 extends obliquely away from the mounting member 32 and obliquely towards the lower slot forming flange 55, so as to form an oblique surface that can engage a distal end, preferably a chamfered distal end, of a lock piece of a mounting member 80 of the gutter piece 10 to help facilitate its insertion into the upper slot. A terminal end of the upper slot forming flange 50 may be chamfered or radiused, preferably with a slope that slopes downwardly as it extends away from mounting member 32 and towards the gutter piece 10. This may help facilitate the insertion and rotation of the upper lock piece 70. The lower slot forming flange 55 may extend perpendicularly away from the mounting member 32 to provide a stable base for another lock piece of a mounting member 80 of the gutter piece 10. A terminal end of the lower slot forming flange may comprise a chamfered or radiused end, which may make it easier to insert the lock piece 75 into the lower slot 40.

The upper slot 35 is deeper and/or wider than the lower slot 40. That is, the upper slot forming flange 50 is longer than the lower slot forming flange 55 so that the upper slot 35 is deeper than the lower slot 40 and the upper slot forming flange 50 is spaced further away from the mounting member 32 than the lower slot forming flange 55 that the upper slot 35 is a wider slot than the lower slot 40. This may facilitate easier mounting of the gutter pieces 10.

The end portion of the upper slot forming flange 50 comprises a fixing hole 60 for receiving a fixing 65 such as a bolt or screw therethrough.

The slots 35, 40 receive respective lock pieces 70, 75 of a mounting part 80 of one of the gutter pieces 10. The lock pieces comprise an upper lock piece 70 and a lower lock piece 80 which extend oppositely from each other and are spaced away from the outer surface of a side wall part of the wall that defines the drainage channel 85. A distal end of the upper lock piece 70 is chamfered to facilitate easier insertion into the upper slot 35. The fixing 65 can then be inserted into the fixing hole 60 so as to lock the mounting part 80 of the gutter piece 10 to the mounting bracket 20.

Each gutter piece 10 comprises a water tight drainage channel 85 that runs the length of the gutter piece 10 for carrying water therealong, the drainage channel 85 comprising a U-shaped cross sectional wall that is open at a mouth 90 at the top that runs the length of the elongate gutter piece 10. The mounting member 80 of the gutter piece 10 extends from an outer side of the wall of the drainage channel 85.

An edge part 95 of the drainage channel 85 that is closest to the mounting member 80 loops back in on itself towards the interior of the drainage channel 85 to define a recess 100. An opposite edge part 105 of the drainage channel 85 that is furthest from the mounting member 80 defines an outwardly protruding edge of the gutter piece 10. The provision of the outwardly protruding edge can provide a comfortable finger grip and helps resist deformation of the front edge of the gutter piece 10, e.g. if a ladder is placed against it. An inner side part of the edge part 105 defines a protruding clip 110. The opposite edge part 105 may optionally be thickened for extra strength, e.g. to form a bead for extra strength.

In this example, the gutter pieces 10 and the mounting brackets 20 are separate pieces and the means for mounting and demounting the gutter pieces 10 from the mounting brackets 20 is shown in FIGS. 2 to 11.

The gutter piece 10 is moved upwards at a slightly tilted angle, leaning the upper lock piece 70 of the mounting part 80 of the gutter piece 10 towards the mounting bracket(s) 20, so that the engaging chamfered distal end of the upper lock piece 70 of the mounting part 80 of the gutter piece 10 engages with the upper slot forming flange of the mounting bracket(s) 20 and the upper lock piece 70 of the mounting part 80 of the gutter piece 10 slides in to the upper slot 35 of the mounting bracket(s) 20.

The gutter piece 10 is then rotated back to that the upper and lower lock pieces 70, 75 are rotated towards vertical so that the lower lock piece 75 of the mounting part of the gutter piece 10 engages a radiused or angled end of the lower slot forming flange, which assists the lower lock piece 75 into the lower slot 40. Then the retaining fixing 65 is screwed in through the front face of the upper lock piece 70, which prevents the gutter piece 10 uncoupling.

To remove the gutter piece 10 from the mounting bracket 20, the above process is performed in reverse.

Where two lengths of gutter piece 10 are to be joined to extend the length, then the connector 15 is clipped in to the top of a pair of longitudinally abutting gutter pieces 10.

The connector 15 has a substantially U-shaped cross sectional profile and defines a water tight fluid channel 115 that runs along the length of the connector 15 (i.e. into and out of the page). The connector 15 has a general shape complementary to that of the inside of the drainage channels 85 of the gutter pieces 10 so that the connector is configured to fit to the inside of the drainage channels 85 of the gutter pieces 10. The fluid channel 115 defined by the connector 15 is an open fluid channel, open at a mouth at the top thereof and configured to convey fluid therealong. The open mouth of the fluid channel 155 of the connector is provided between opposing edges 120, 125 of a wall 130 of the connector 15 that defines the fluid channel 115.

One of the edges 120 of the wall 130 of the connector 15 comprises a chamfered edge that slopes downwardly from an exterior of the wall 130 towards an interior. The chamfered edge is an edge 120 of the wall 130 of the connector 15 closest to the mounting bracket 20 in use. The chamfered edge 120 is received within the recess 10 defined in the edge part 95 of the wall 130.

The other edge 125 of the wall 130 of the connector 15 comprises an outer flat section 135. The outer flat section 135 provides a convenient thumb grip such that both of the outer flat section 135 and the opposite edge part 105 of the drainage channel 85 that defines an outwardly protruding edge of the gutter piece 10 can be used to form pressure on the pieces to perform the clip connection easily.

The connector 15 comprises a catch member 140 that extends outwardly from an outer surface of a side part of the wall 130 of the connector 15. The catch member 140 is located away from the edges of the connector 15. The catch member 140 is configured to resiliently and releasably lock the catch 110 of at least one or both of the gutter pieces 10. The catch member 140 on the connector 15 and the catch 110 on the gutter piece or pieces 10 are inverted with respect to each other and form cam surfaces so they cam over each other as they are being engaged together. It is important that sealant is not disturbed/smudged prior to the final click in of the connector 15 into the gutter pieces 10. The catch member 140 and catch 110 are arranged such that as the connector 15 begins to engage the gutter pieces 10 in a rotational way, the protruding catch member 140 which engages with and cams off the inverted protruding catch 110, which keeps the walls of the gutter piece 10 separated from the connector 15 on the final approach prior to the clip in action. The catch member 140 and catch 110 interlock so as to resist the catch from uncoupling.

In an alternative or additional approach, rather than rotate the connector 15 into place to connect the gutter pieces 10, the connector 15 may be slid into the end of one of the gutter pieces 10 and the other gutter piece 10 can be slid onto the opposite end of the connector 15 so that the two gutter pieces 10 abut or are adjacent each other, with the connector 15 covering the join between the gutter pieces 10 from inside the drainage channels 85 of the gutter pieces 10.

A stop or spacer member 145 is provided on the outer surface of the side wall section of the wall 130 of the connector 15. The spacer member 145 is provided between the flat section 135 and the catch member 140 of the connector 15 and extends outwardly and proud of the outer surface of the side wall section of the wall 130 of the connector 15. In this way, the spacer member 145 creates a gap 150 between the outer surface of the side wall section of the connector 15 and the inner surface of the drainage channel(s) 85 of the gutter pieces 10. This makes it easier to insert a prying tool, such as a screwdriver into the gap 150 to release the catch member 140 from the catch 110 and thereby to release the connector 15 from the gutter piece or pieces 10.

The edge 120 of the connector 15 closest to the mounting bracket(s) 20 has the chamfered edge 120 to assist engagement with an invertedly chamfered edge 95 of the drainage channel 95 of the gutter pieces 10 to facilitate correct insertion of the edge 120 of the connector 15 into the recess 100.

Prior to the connector 15 being clipped in, a layer of suitable waterproof sealant is applied to the upper surface of the engaging part of the end of both gutter pieces 10. This creates a waterproof seal in a gap 155 between the connector 15 and the inner surface of the drainage channel 85 of the gutter piece 10. As described above, the catch member 140 and catch 110 are arranged such that as the connector 15 begins to engage the gutter pieces 10 in a rotational way, the protruding catch member 140 engages with, and cams off, the inverted protruding catch 110, which keeps the walls of the gutter piece 10 separated from the connector 15 on the final approach prior to the clip in action. This prevents the sealant from being disturbed or smudged FIGS. 12 to 17 show the connecting of the two gutter pieces 10 of the gutter system 5 using the connector 15.

Figure 18:
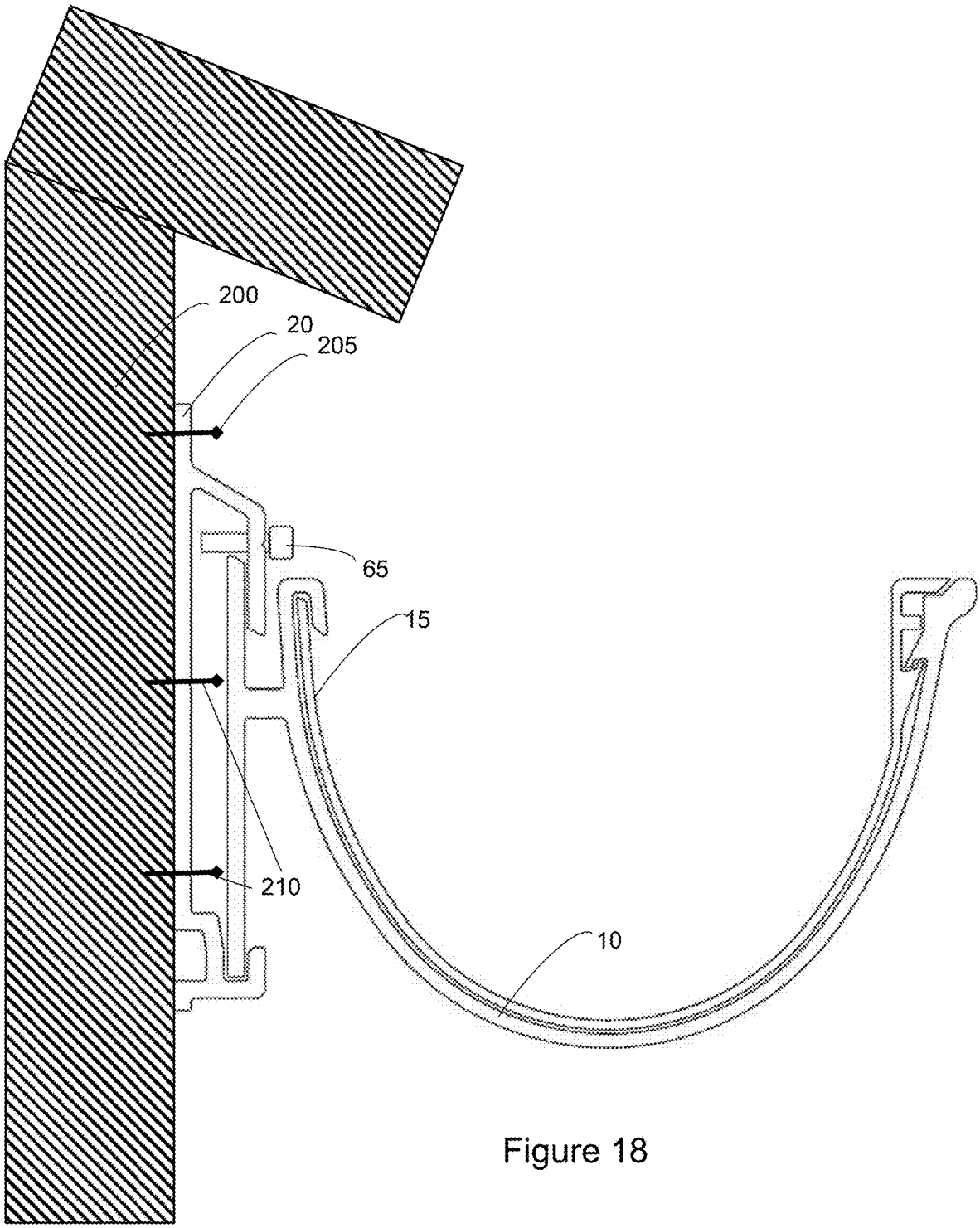
FIG. 18 shows the gutter system of FIG. 1 mounted to a wall.

FIG. 18 shows the assembled gutter system 5 mounted to a wall 200. The brackets 20 are screwed into the wall using the fixings 205, 210 such as screws that are received through the fixing points 25, 30 in the form of screw holes. Fixings 210 are hidden behind the gutter pieces 10, whilst upper fixing 210 is exposed.

Figure 19:
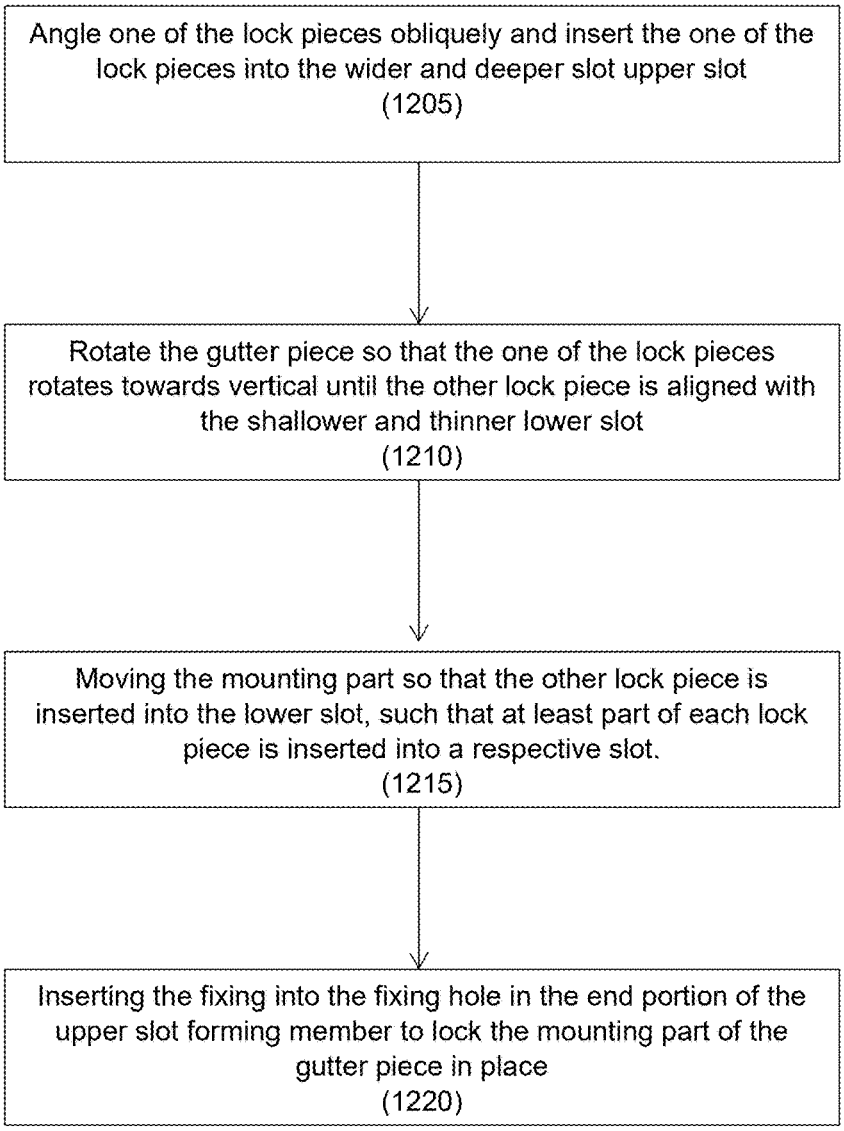
FIG. 19 is a flowchart illustrating a method of connecting the gutter piece of the gutter system of FIG. 1 to the mounting bracket.

FIG. 19 illustrates a process of mounting the gutter piece 10 to the mounting bracket 20.

In step 1205 the upper lock piece 70 is angled obliquely and inserted into the wider and deeper slot upper slot 35.

In step 1210 the gutter piece 10 is rotated so that the upper and lower lock pieces 70, 75 rotate towards vertical until the lower lock piece 75 is aligned with the shallower and thinner lower slot 40.

In step 1215 the gutter piece 10 and its mounting part 80 is moved so that the lower lock piece 75 is slid downwards into the lower slot 40, such that at least part of each lock piece 70, 75 is inserted into the respective slot 35, 40.

In step 1220, the fixing 65 is inserted into the fixing hole 60 in the end portion of the upper slot forming flange 50 to lock the mounting part 80 of the gutter piece 10 onto the mounting bracket 20.

Figure 20:
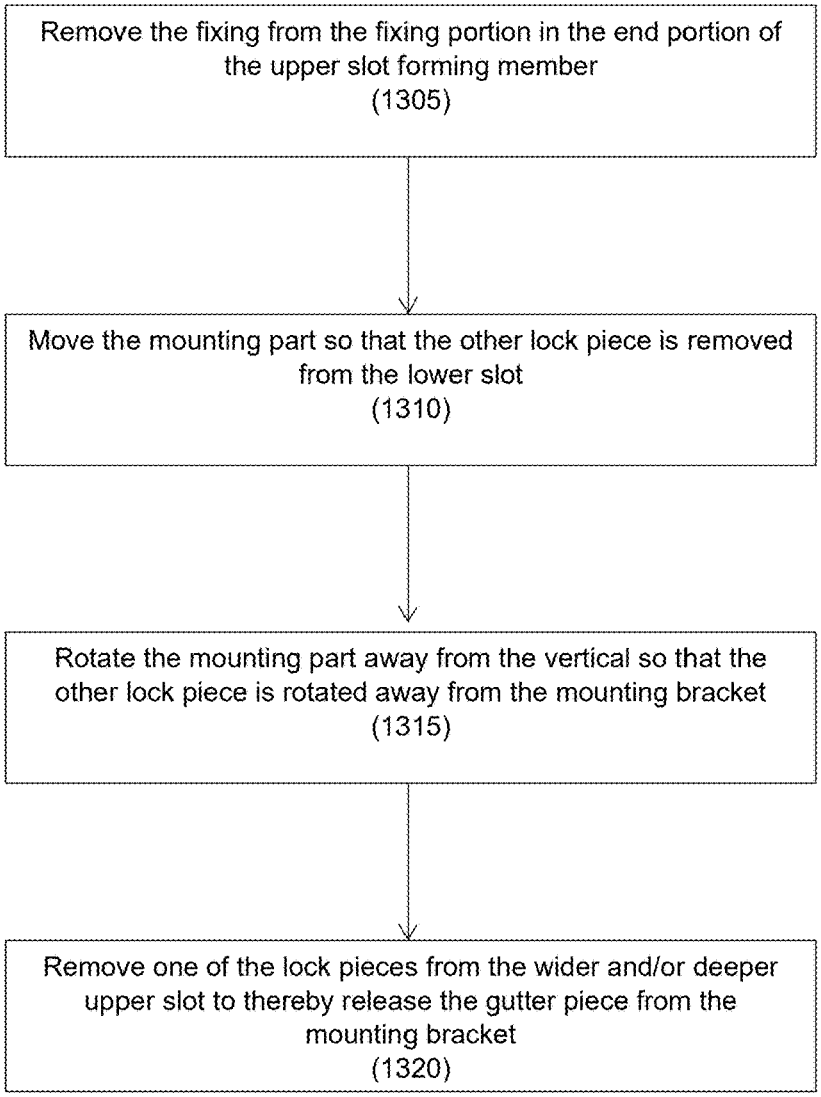
FIG. 20 is a flowchart illustrating a method of disconnecting the gutter piece of the gutter system of FIG. 1 from the mounting bracket.

FIG. 20 illustrates a process for removing the gutter piece 10 from the mounting bracket 20.

In step 1305, the fixing 65 is removed from the fixing hole 60 in the end portion of the upper slot forming flange 50.

In step 1310, the gutter piece 10 is slid upwards so that the lower lock piece 75 is removed from the lower slot 40.

In step 1315, the gutter piece 10 is rotated so that the locking pieces 70, 75 are rotated away from the vertical so that the lower lock piece 75 is rotated away from the mounting bracket 20.

In step 1320, the upper lock piece 70 is removed from the wider and/or deeper upper slot 35 to thereby release the gutter piece 10 from the mounting bracket 20.

Figure 21:
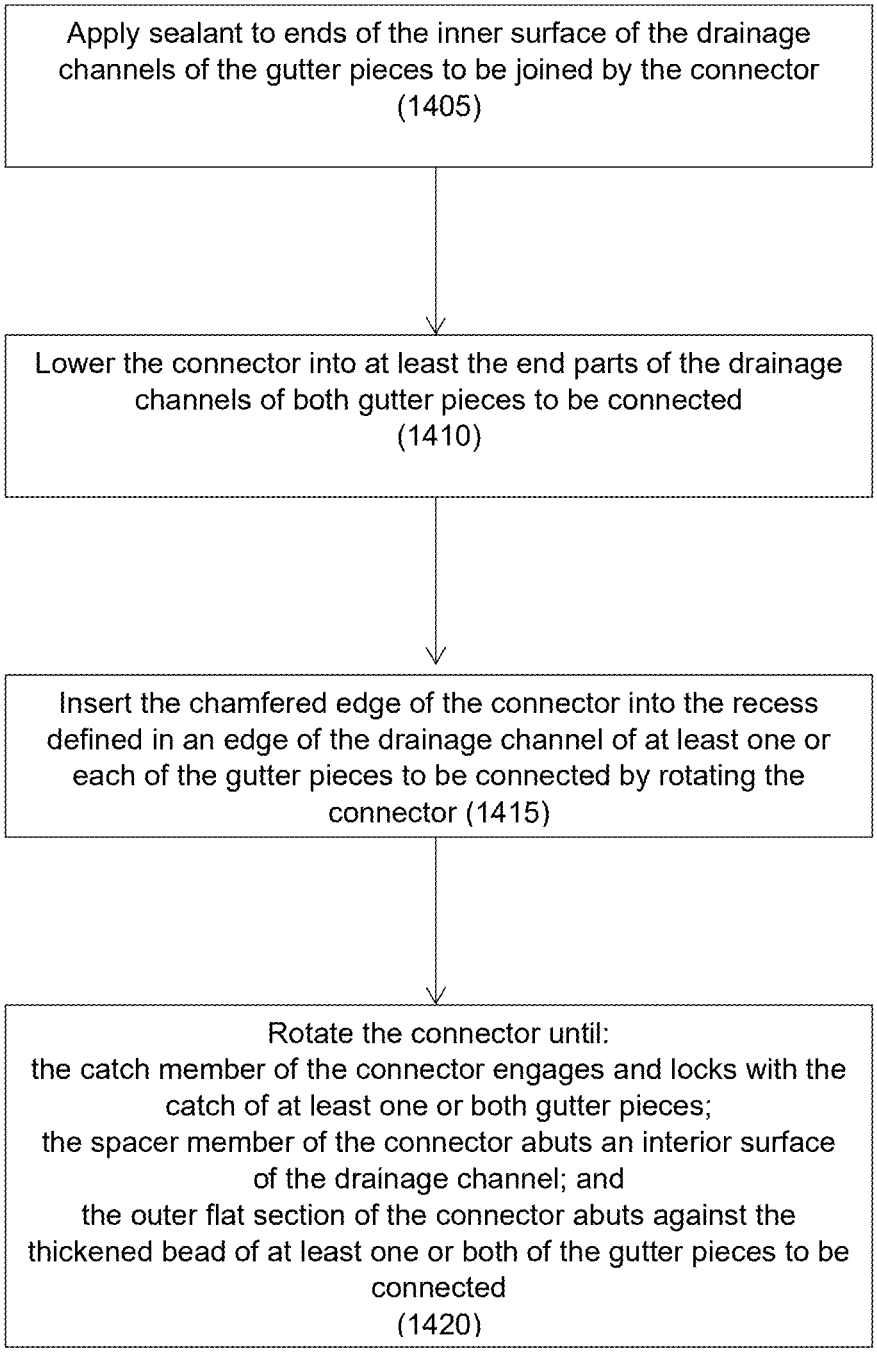
FIG. 21 is a flowchart illustrating a method of connecting the two gutter pieces of the gutter system of FIG. 1 using a connector of the gutter system of FIG. 1.

FIG. 21 illustrates a method of connecting two gutter pieces 10 together using the connector 20.

In step 1405, sealant is applied to ends of the inner surface of the drainage channels 85 of the gutter pieces 10 to be joined by the connector 20.

In step 1410, the connector 20 is lowered into at least the end parts of the drainage channels 85 of both gutter pieces 10 to be connected.

In step 1415, the chamfered edge 120 of the connector 20 is rotated so as to be inserted into the recess 100 defined in the edge 95 of the drainage channel 85 of each of the gutter pieces 10 to be connected.

In step 1420, the connector 20 continues to be rotated until the catch members 140 of the connector 20 engages and locks with the catches 110 of both gutter pieces the spacer members 145 of the connector 20 abut an interior surface of the drainage channel 85; and the edge 125 of the connector 20 abuts against the thickened bead of at least one or both of the gutter pieces 10 to be connected.

Figure 22:
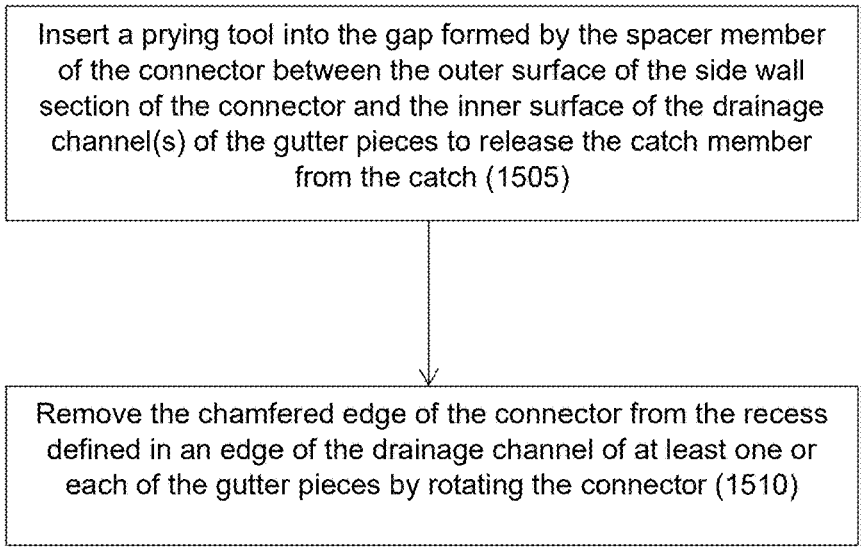
FIG. 22 is a flowchart illustrating a method of disconnecting the connector and two gutter pieces of the gutter system of FIG. 1.
Figure 23:
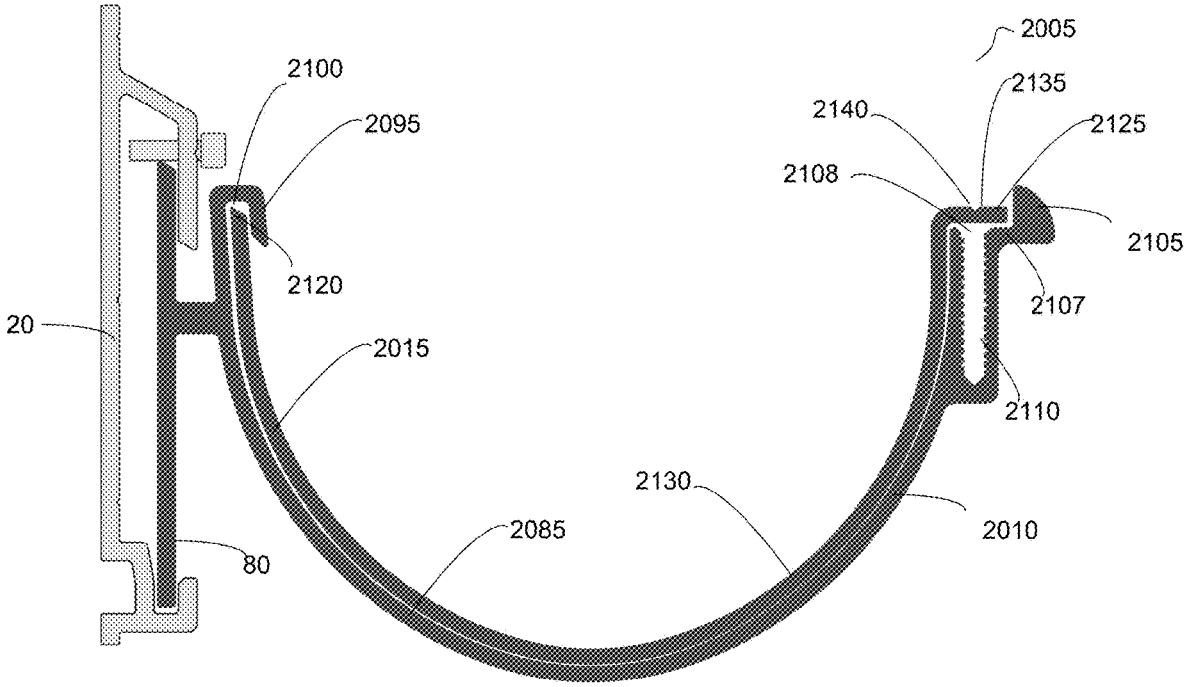
FIG. 23 is a cross section of an alternative gutter system.

FIG. 22 illustrates a method of disconnecting the two gutter pieces 10 and the connector 20.

In step 1505, a prying tool is inserted into the gap 150 formed by the spacer member 145 of the connector 20 between the outer surface of the side wall section of the connector 20 and the inner surface of the drainage channel(s) 85 of the gutter pieces 10 to release the catch member 140 from the catch 110.

In step 1510, the chamfered edge 120 of the connector 20 is removed from the recess 100 by rotating the connector 20.

FIGS. 23 to 28 show a gutter system 2005 that is a variation of the gutter system 5 shown in FIGS. 1 to 18 and for which like components are provided with the same reference numerals but increased by 2000.

The gutter system 2005 shown in FIGS. 23 to 28 comprises at least two gutter pieces 2010 (again, only one being shown as the other gutter piece 2010 is behind the shown gutter piece 2010, into the page) connected or connectable by a connector 2015. The gutter system 2005 comprises a plurality of mounting brackets 20, which are the same as the mounting brackets 20 shown in, and described in relation to, FIGS. 1 to 18. Each gutter piece 2010 comprises the same mounting member 80 as the gutter pieces 10 shown in FIGS. 1 to 18, so that the gutter pieces 2010 can connect to the mounting brackets 20 using a rock and lock mechanism, in the same way as described above in relation to FIGS. 1 to 22.

The gutter pieces 2010 define a drainage channel 2085 similarly to the drainage channel 85 shown in FIGS. 1 to 18. Similarly, to the embodiment of FIGS. 1 to 18, an edge part 2095 of the drainage channel 2085 that is closest to the mounting member loops back in on itself towards the interior of the drainage channel 2085 to define a recess 2100. Similarly, to the embodiment of FIGS. 1 to 18, one of the edges 2120 of a wall 2130 of the connector 2015 comprises a chamfered edge that slopes downwardly from an exterior of the wall 2130 towards an interior. The chamfered edge is an edge 2120 of the wall 2130 of the connector 2015 closest to the mounting bracket 20 in use. The chamfered edge 2120 is received within the recess 2100 defined in the edge part 2095 of the gutter pieces 2010.

Figure 24:
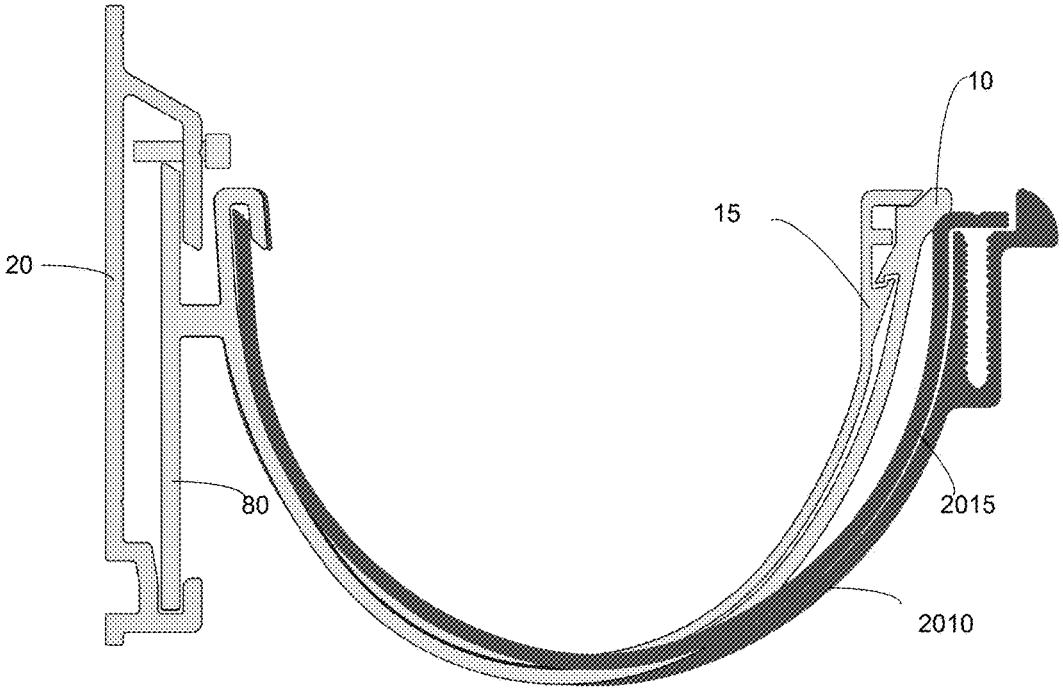
FIG. 24 shows a comparison between the gutter systems of FIG. 1 and FIG. 23.

As can be seen particularly from FIG. 24, the main difference between the example of FIGS. 1 to 18 and that of FIGS. 23 to 28 lies in the mechanism by which another of the edges 2125 of the wall 2130 of the connector 2015 that is opposite the edge 2120 connects to the gutter pieces 2010. In the embodiment of FIGS. 1 to 18, the other edge 125 of the wall 130 of the connector 15 clips and latches to the gutter pieces 10 via the catch member 140 and the catch 110.

In contrast, in the embodiment of FIGS. 23 to 28, a fixing structure 2110 that comprises a threaded recess for threadably receiving a screw or bolt, and is provided in a thickened part of a wall that forms the drainage channel 2085, so as to lie between the interior of the drainage channel 1085 and an outwardly protruding edge 2105 of the gutter pieces 2010 that is optionally thickened to form a bead. A part 2107 of the wall that forms the drainage channel 2085 that contains an opening 2108 of the threaded recess 2100 is flat and optionally in use extends horizontally so as to engage and abut an outer flat section 2135 of the other edge 2125 of the wall 2130 of the connector 2015.

The outer flat section 2135 of the connector 2015 comprises a fixing arrangement 2140 in the form of a through hole or thinned wall section for receiving a fixing, such as a threaded fixing e.g. a screw or bolt, therethrough.

Figure 25:
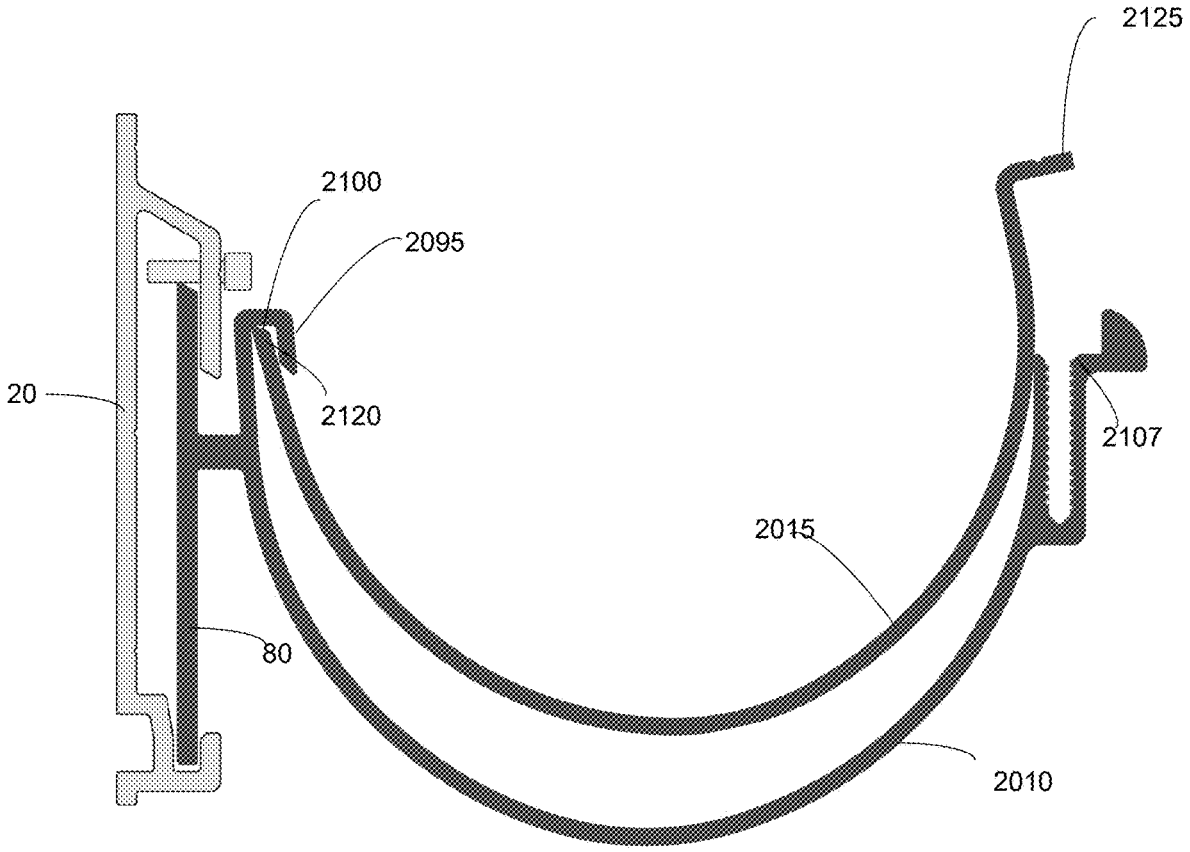
FIGS. 25 to 28 show the connecting of two gutter pieces of the gutter system of FIG. 23 using a connector of the gutter system of FIG. 23.

FIGS. 25 to 28 show the connection of adjacent gutter pieces 2010 using the connector 2015. The two longitudinal gutter pieces 2010 are placed adjacent in an end-to-end configuration (so that they extend into and out from the page in FIGS. 25 to 28). Sealant, such as silicone sealant, is applied to ends of an inner surface of the drainage channels 2085 of each of the gutter pieces 2010 to be joined by the connector 2015. As shown in FIG. 25, the connector 2015 is angled so that the edge 2120 (e.g. the chamfered edge) of the wall 2130 of the connector 2015 can be inserted into the recesses 2100 formed on the inward side of the edge 2085 of the drainage channels 2085 at each end of the adjoining gutter pieces 2010.

Figure 26:
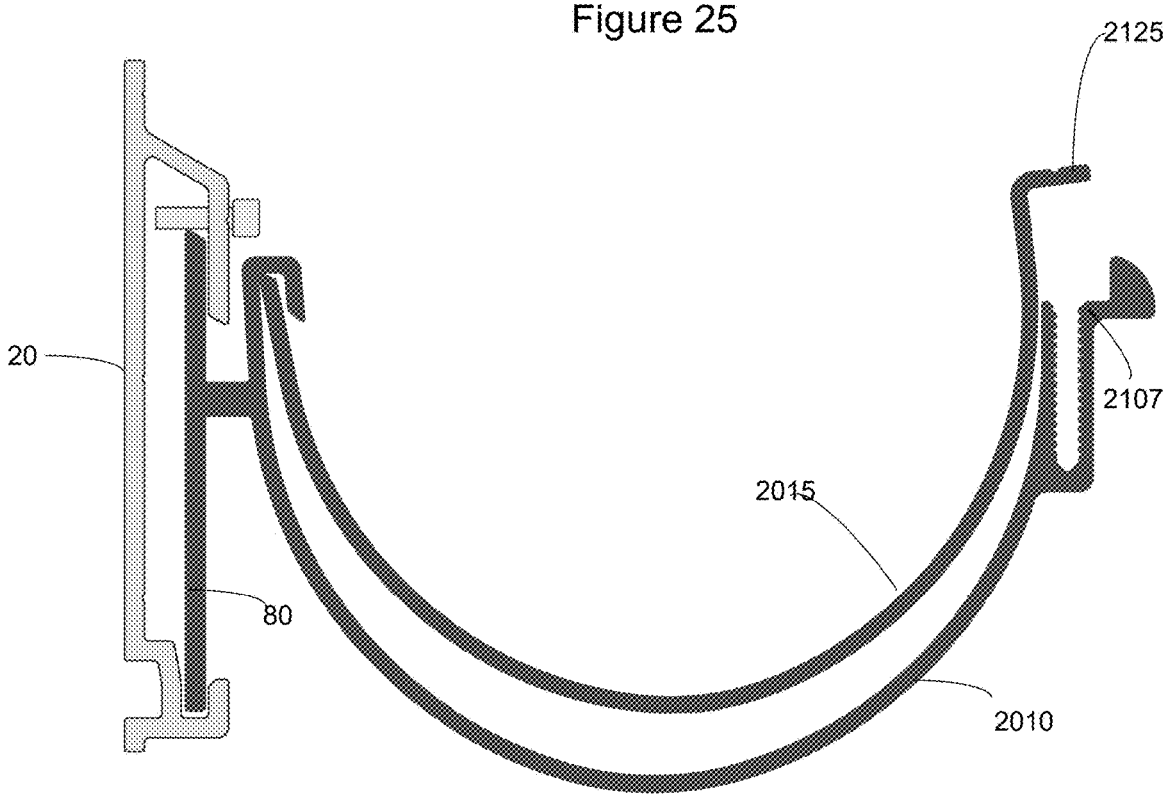
Figure 27:
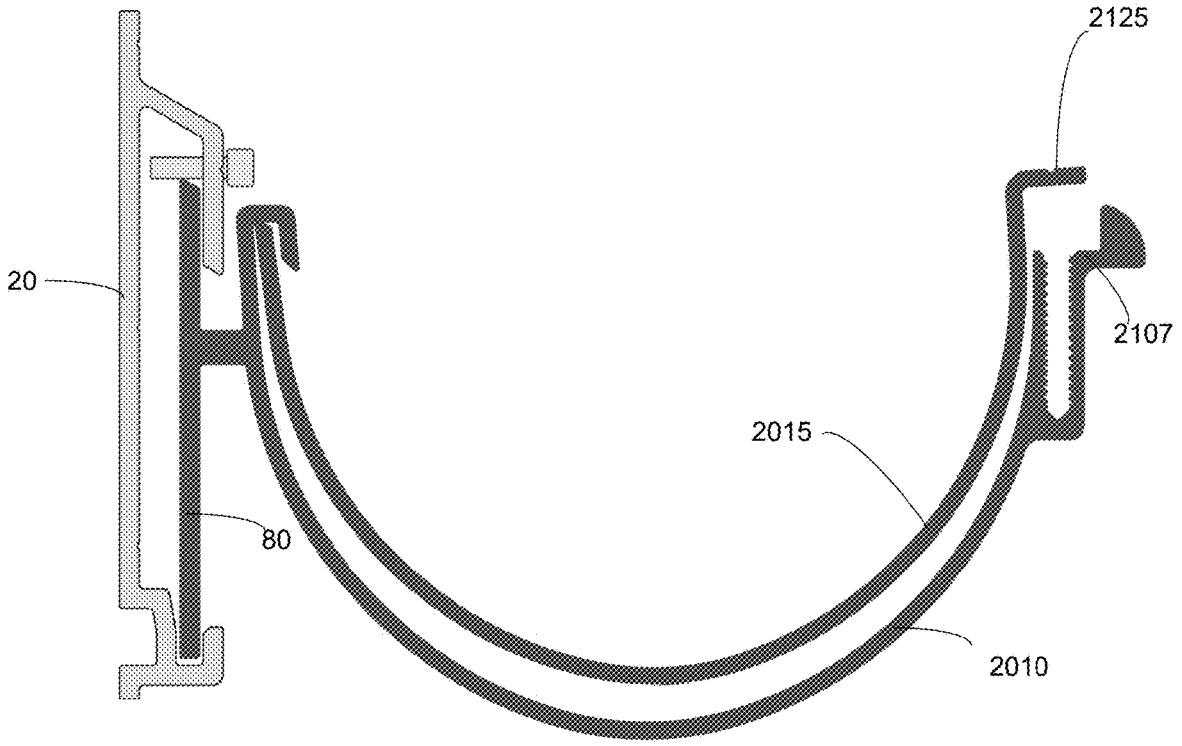
Figure 28:
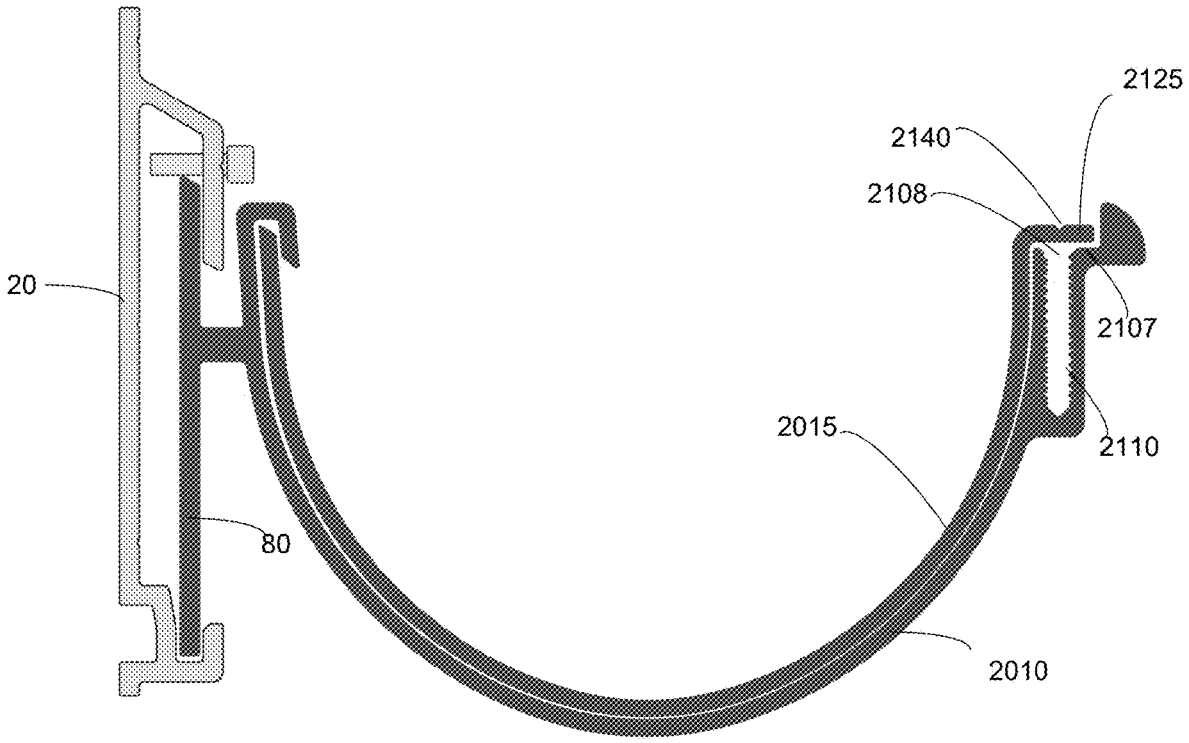

As can be seen from FIGS. 26 to 28, the connector 2015 is then rotated around so that the outer flat section 2135 of the edge 2125 of the wall 2130 of the connector 2015 is rotated towards, and eventually so as to be adjacent to or in abutting contact with, the flat parts 2107 at the abutting ends of the walls of each of the adjacent gutter pieces 2010. The sealant remains between the outer surface of the connector 2015 and an inner surface of the drainage channels 2085 of each of the adjacent gutter pieces 2010.

The fixing, such as a screw, bolt or push stud, can then be inserted through the fixing arrangement 2140 (e.g. a through hole), and fixed into the fixing structure 2110 (e.g. a threaded recess or a recess for receiving a push stud) so as to fix the other edge 2150 of the connector 2010 to one of the gutter pieces 2010. Another fixing can then be inserted through another fixing arrangement 2140 and fixed into the fixing structure 2110 of the adjacent gutter piece 2010 in order to securely join the two adjacent gutter pieces 2010 via the connector 2015.

Figure 29:
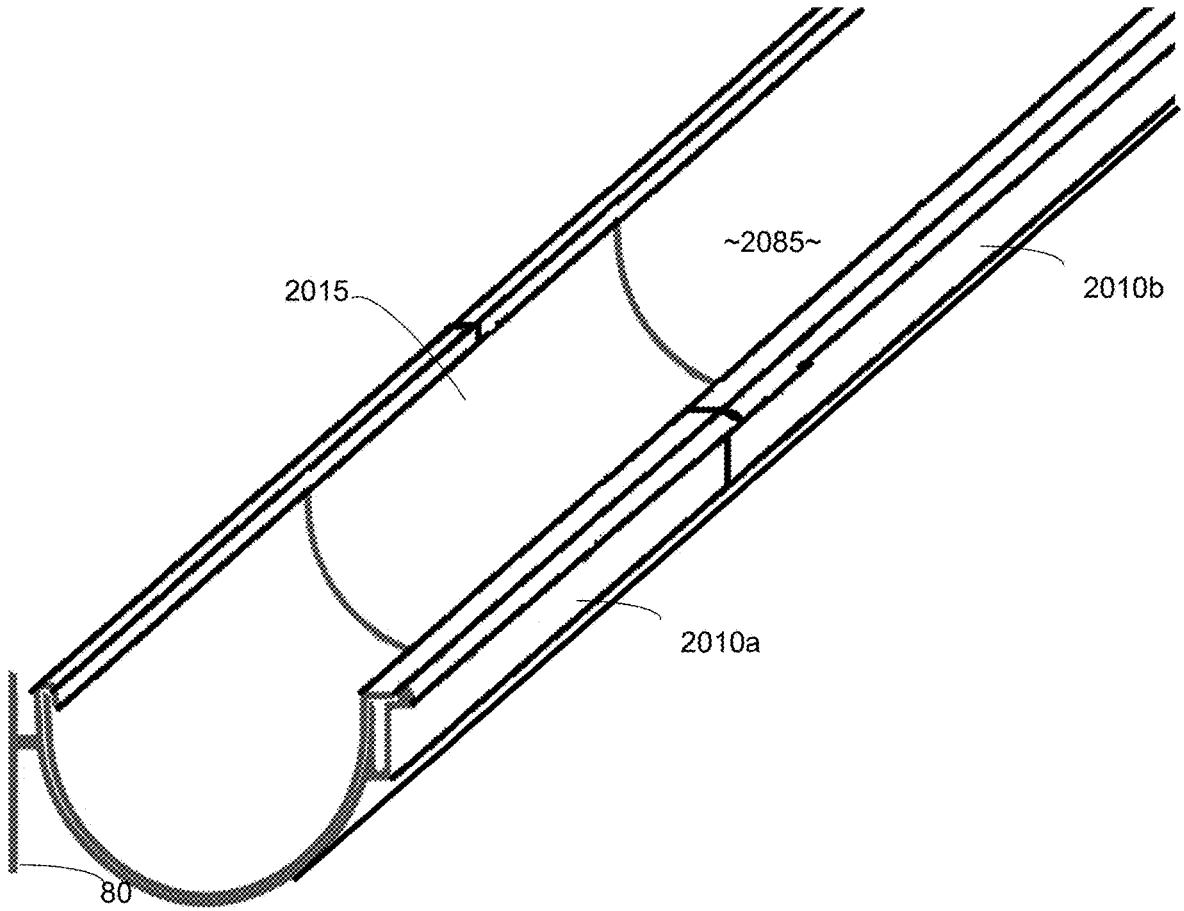
FIG. 29 shows a perspective view of two gutter pieces of the gutter system of FIGS. 23 to 28 connected with a connector.

FIG. 29 shows a perspective view of two gutter pieces 2010*a*, 2010*b* of the gutter system of FIGS. 23 to 28 connected with a connector 2015. It can be seen that the gutter pieces 2010*a*, 2010*b* are elongate and the connector 2015 is shorter than the gutter pieces 2010*a*, 1010*b* and covers the join between the gutter pieces 2010*a*, 2010*b*. The connector 2015 sits in the drainage channel 2085 of each gutter piece 2010*a*, 2010*b*, and connects to each gutter piece 2010*a*, 2010*b*, e.g. via a screw fixing structure 2110 as shown in FIGS. 23 to 28 or the clip 110 and catch member 140 as shown in FIGS. 1 to 18. It will be appreciated that the configuration of gutter pieces 2010*a*, 2010*b* and connector 2015 shown in FIG. 29 is equally applicable to the embodiment of FIGS. 1 to 18 and to that of FIGS. 23 to 28. The mounting members 80 on each gutter piece 2010*a*, 2010*b* fit to corresponding mounting members 80 in the manner described above, via a rock and lock action.

It will be appreciated that variations on the above are possible. For example, rather than rotate the connector 15, 2015 into position, the connector 15, 2015 can be slid into position, e.g. by sliding part of at least the edge 95, 2095 of the connector 15, 2015 into the recess 100, 2100 of one gutter piece 10, 2010 and then sliding the recess 100, 2100 onto another part of the edge 95, 2095 of the connector 15, 2015.

Furthermore, although a threaded fixing is described above, the fixing can be a nail, tack, clip or a pop stud, or other fixing known in the art.

The invention claimed is:

1. A guttering kit or assembly comprising at least one gutter piece and at least one mounting bracket for mounting the gutter piece to a surface, wherein the gutter piece comprises an elongate drainage channel and one or more mounting parts, each of the one or more mounting parts comprising an extending part that extends from, and away from, an external side wall portion of the drainage channel at least to a pair of lock pieces that extend from, and away from, the extending piece and away from each other; and the mounting bracket comprises a mounting member for mounting to the surface, and a pair of opposing slots that include an upper slot and a lower slot, each of the opposing slots being formed by a respective slot forming member, each slot forming member comprising a spacing portion that extends obliquely or perpendicularly away from the mounting member to an end portion that extends obliquely or perpendicularly from the spacing portion so as to form the slot between the end portion and the mounting member; wherein respective slots of the pair of opposing slots of the mounting bracket accommodate or are configured to receive respective lock pieces of the pair of lock pieces to mount the gutter piece to the mounting bracket; and wherein the respective slots of the pair of opposing slots of the mounting bracket are configured to receive respective lock pieces of the pair of lock pieces to mount the gutter piece to the mounting bracket in a rock and lock manner in which the gutter piece is oriented to be obliquely angled with respect to the mounting bracket and one of the lock pieces is inserted into the upper slot before the gutter piece is rotated until the other lock piece is aligned with the lower slot, and thereafter the gutter piece moved so that the other lock piece is inserted into the lower slot, so that each lock piece of the gutter is received and retained in a respective slot of the pair of opposing slots.

2. The guttering kit or assembly of claim 1, comprising at least two of the gutter pieces and a connector that connects or for connecting the gutter pieces.

3. The guttering kit or assembly of claim 2, wherein the connector comprises a wall member that defines a substantially U-shaped or semicircular cross sectional profile that extends between two edges, one edge being provided with a chamfered profile.

4. The guttering kit or assembly of claim 2, wherein the connector further comprises a protruding member that extends outwardly from an outer surface of a side wall part of the wall of the connector on a side of the connector; and each of the gutter pieces comprises a protruding catch that extends out from an inner side of the other side wall portion of the drainage channel and configured to resiliently receive and releasably lock the catch member of a connector when the connector is in a position abutting the interior of the drainage channel of the gutter piece.

5. The guttering kit or assembly of claim 2, wherein:

a protruding member that extends outwardly from an outer surface of a side wall part of the wall of the connector on a side of the connector comprises a fixing arrangement for receiving a fixing therethrough; and each of the gutter pieces comprises a protruding part that extends out from an inner side of the other side wall portion of the drainage channel and is configured to receive and fix to the fixing.

6. A guttering kit or assembly, comprising at least two gutter pieces, a mounting bracket and a connector that connects or is for connecting the gutter pieces, wherein each of the gutter pieces comprises one or more mounting parts, each of the one or more mounting parts comprising an extending part that extends from, and away from, an external side wall portion of the drainage channel at least to a pair of lock pieces that extending from, and away from, the extending piece and away from each other, and an elongate drainage channel for conveying fluid therealong;

the mounting bracket comprises a mounting member for mounting to the surface, and a pair of opposing slots, each of the opposing slots being formed by a respective slot forming member, each slot forming member comprising a spacing portion that extends obliquely or perpendicularly away from the mounting member to an end portion that extends obliquely or perpendicularly from the spacing portion so as to form the slot between the end portion and the mounting member; and wherein respective slots of the pair of opposing slots of the mounting bracket accommodate or are configured to receive respective lock pieces of the pair of lock pieces to mount the gutter piece to the mounting bracket;

the connector comprises a wall member that defines a profile matches an interior profile of the elongate channel of the gutter piece and that extends between two edges, one edge being provided with a chamfered profile, and the connector further comprising a protruding catch member that extends outwardly from an outer surface of a side wall part of the wall of the connector on a side of the connector that is opposite to the side on which the chamfered edge is provided; and each of the gutter pieces comprises a protruding catch that extends out from an inner side of the other side wall portion of the drainage channel and configured to resiliently receive and releasably lock the catch member of a connector when the connector is in a position abutting the interior of the drainage channel of the gutter piece.

7. The guttering kit or assembly of claim 1, wherein one of the slot forming members is an upper slot forming member that defines an upper slot and is locatable above the other, lower, slot forming member that defines a lower slot, in use.

8. The guttering kit of claim 7, wherein the upper slot is deeper and/or wider than the lower slot.

9. The guttering kit of claim 7, wherein at last one of:

the upper slot forming member comprises a spacing portion that extends obliquely away from the mounting member to an end portion that extends obliquely or perpendicularly from the spacing portion so as to form the upper slot between the end portion and the mounting member; and/or the lower slot forming member comprises a spacing portion that extends perpendicularly away from the mounting member to an end portion that extends obliquely or perpendicularly from the spacing portion so as to form the lower slot between the end portion and the mounting member.

10. The guttering kit or assembly of claim 7, wherein the upper slot forming member comprises a fixing hole for receiving a fixing such as a bolt or screw therethrough for securing the lock pieces of the gutter piece in the respective slots.

11. The guttering kit or assembly according to claim 3, wherein at least part of an edge of the drainage channel that partly defines a mouth of the drainage channel defines a recess facing the interior of the drainage channel for receiving the chamfered edge of the connector, and wherein a terminal end of the edge of the drainage channel that defines the recess is chamfered or radiused.

12. The guttering kit or assembly according to claim 3, wherein a spacer member is provided on, and extending outwardly from, the outer surface of the side wall part of the wall of the connector on the side of the connector that is opposite to the side on which the chamfered edge is provided, wherein the spacer member is configured to create a gap between part of the outer surface of the side wall section of the connector and part of the inner surface of the drainage channel of the gutter piece when the connector is locked in situ in the drainage channel of the gutter piece.

13. The guttering kit or assembly according to claim 3, wherein a terminal end of the side wall part of the wall of the connector on the side of the connector that is opposite to the side on which the chamfered edge is provided comprises an outer flat section.

14. The guttering kit or assembly according to claim 11, wherein an edge of the drainage channel opposite the edge of the sidewall portion of the drainage channel that defines the recess, defines an outwardly protruding portion and/or thickened bead portion, that extends along most or all of the length of the edge of the drainage channel.

15. The guttering kit or assembly according to claim 6, wherein at least one of: the upper lock piece terminates in a chamfered or radiused end; a terminal end of the upper slot forming member is chamfered or radiused and/or a terminal end of the lower slot forming member is chamfered or radiused.

16. A method of mounting a gutter piece to a mounting bracket, the gutter piece comprising an elongate drainage channel and one or more mounting parts, each of the one or more mounting parts comprising an extending part that extends from, and away from, an external side wall portion of the drainage channel at least to a pair of lock pieces that extend from, and away from, the extending piece and away from each other;

the mounting bracket comprising a mounting member for mounting to the surface, and a pair of opposing slots that include an upper slot and a lower slot, each of the opposing slots being formed by a respective slot forming member, each slot forming member comprising a spacing portion that extends obliquely or perpendicularly away from the mounting member to an end portion that extends obliquely or perpendicularly from the spacing portion so as to form the slot between the end portion and the mounting member; and wherein respective slots of the pair of opposing slots of the mounting bracket accommodate or are configured to receive respective lock pieces of the pair of lock pieces to mount the gutter piece to the mounting bracket; and the method comprising:

angling the gutter piece obliquely with respect to the mounting bracket and thereafter inserting the one of the lock pieces into the upper slot;

then rotating the gutter piece until the other lock piece is aligned with the lower slot;

and thereafter moving the mounting part so that the other lock piece is inserted into the lower slot such that at least part of each lock piece is inserted into a respective slot.

17. A method of demounting a gutter piece from a mounting bracket, the gutter piece comprising an elongate drainage channel and one or more mounting parts, each of the one or more mounting parts comprising an extending part that extends from, and away from, an external side wall portion of the drainage channel at least to a pair of lock pieces that extend from, and away from, the extending piece and away from each other;

the mounting bracket comprising a mounting member for mounting to the surface, and a pair of opposing slots that include an upper slot and a lower slot, each of the opposing slots being formed by a respective slot forming member, each slot forming member comprising a spacing portion that extends obliquely or perpendicularly away from the mounting member to an end portion that extends obliquely or perpendicularly from the spacing portion so as to form the slot between the end portion and the mounting member; and wherein respective slots of the pair of opposing slots of the mounting bracket accommodate or are configured to receive respective lock pieces of the pair of lock pieces to mount the gutter piece to the mounting bracket; and the method comprising:

moving the gutter piece so that one of the lock pieces is removed from the lower slot, with another one of the lock pieces remaining in the upper slot;

rotating the gutter piece with respect to the mounting bracket so that the lock piece is rotated away from the mounting bracket;

removing the other one of the lock pieces from the upper slot to thereby release the gutter piece from the mounting bracket.

18. Producing a gutter piece and a mounting bracket by additive manufacturing, extruding or moulding the gutter piece and the mounting bracket, the gutter piece comprising an elongate drainage channel and one or more mounting parts, each of the one or more mounting parts comprising an extending part that extends from, and away from, an external side wall portion of the drainage channel at least to a pair of lock pieces that extend from, and away from, the extending piece and away from each other; and the mounting bracket comprising a mounting member for mounting to the surface, and a pair of opposing slots that include an upper slot and a lower slot, each of the opposing slots being formed by a respective slot forming member, each slot forming member comprising a spacing portion that extends obliquely or perpendicularly away from the mounting member to an end portion that extends obliquely or perpendicularly from the spacing portion so as to form the slot between the end portion and the mounting member; and the respective slots of the pair of opposing slots of the mounting bracket are configured to receive respective lock pieces of the pair of lock pieces to mount the gutter piece to the mounting bracket in a rock and lock manner in which the gutter piece is oriented to be obliquely angled with respect to the mounting bracket and one of the lock pieces is inserted into the upper slot before the gutter piece is rotated until the other lock piece is aligned with the lower slot, and thereafter the gutter piece moved so that the other lock piece is inserted into the lower slot, so that each lock piece of the gutter is received and retained in a respective slot of the pair of opposing slots.

* * * * *